US006579220B2

(12) United States Patent
Herman et al.

(10) Patent No.: US 6,579,220 B2
(45) Date of Patent: Jun. 17, 2003

(54) DISPOSABLE, SELF-DRIVEN CENTRIFUGE

(75) Inventors: Peter K. Herman, Cookeville, TN (US); Ismail Bagci, Cookeville, TN (US); Byron A. Pardue, Cookeville, TN (US); Mike Conrad, Findlay, OH (US); Mike Yost, Tiffin, OH (US); Richard Jensen, deceased, late of Cookeville, TN (US), by Shirley Ann Jensen, executrix; Hendrik N. Amirkhanian, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/739,070

(22) Filed: Dec. 18, 2000

(65) Prior Publication Data

US 2001/0016549 A1 Aug. 23, 2001

Related U.S. Application Data

(63) Continuation-in-part of application No. 09/348,522, filed on Jul. 7, 1999, now abandoned.

(51) Int. Cl.[7] ..... B04B 1/08; B04B 9/06

(52) U.S. Cl. ..... 494/49; 494/70

(58) Field of Search ..... 494/24, 36, 43, 494/49, 64, 65, 67, 70, 73, 84, 901; 210/168, 171, 232, 380.1, 360.1, 416.5; 184/6.24

(56) References Cited

U.S. PATENT DOCUMENTS

| | | | | |
|---|---|---|---|---|
| 2,335,420 | A | * 11/1943 | Jones | |
| 2,650,022 | A | * 8/1953 | Fulton et al. | |
| 3,791,576 | A | * 2/1974 | Bazil | |
| 4,046,315 | A | * 9/1977 | Klingenberg | |
| 4,221,323 | A | * 9/1980 | Courtot | |
| 4,557,831 | A | 12/1985 | Lindsay | 210/232 |
| 4,787,975 | A | 11/1988 | Purvey | 210/360.1 |
| 4,911,833 | A | 3/1990 | Schoendorfer et al. | 210/167 |
| 4,930,412 | A | 6/1990 | Stroucken | 494/70 |
| 4,943,273 | A | 7/1990 | Pages | 494/41 |
| 5,052,996 | A | 10/1991 | Lantz | 494/68 |
| 5,405,308 | A | 4/1995 | Headley et al. | 494/67 |
| 5,549,821 | A | 8/1996 | Bounnakhom et al. | 210/232 |
| 5,637,217 | A | 6/1997 | Herman et al. | 210/380.1 |
| 5,693,217 | A | * 12/1997 | Erdmannsdoerfer et al. | |
| 5,906,733 | A | * 5/1999 | Purvey | |
| 6,017,300 | A | * 1/2000 | Herman | |
| 6,019,717 | A | * 2/2000 | Herman | |
| 6,183,407 | B1 | 2/2001 | Hallgren et al. | 494/49 |
| 6,196,962 | B1 | 3/2001 | Purvey et al. | 494/49 |
| 6,224,531 | B1 | 5/2001 | Frehland et al. | 494/49 |

FOREIGN PATENT DOCUMENTS

| | | |
|---|---|---|
| GB | 2 049 494 A | 12/1980 |
| JP | 47-11706 | of 1972 |
| WO | WO 92/16303 | 10/1992 |
| WO | WO 98/46361 | 10/1998 |

* cited by examiner

*Primary Examiner*—Charles E. Cooley
*Assistant Examiner*—David Sorkin
(74) *Attorney, Agent, or Firm*—Woodard, Emhardt, Moriarty, McNett & Henry LLP

(57) ABSTRACT

A disposable, cone-stack, self-driven centrifuge rotor assembly for separating particulate matter out of a circulating flow of oil includes first and second rotor shell portions which are injection molded out of plastic and joined together by induction welding engaging edges so as to create an enclosing shell with a hollow interior. An injection molded, plastic support hub is assembled into a central opening in the lower half of the rotor shell and extends upwardly into the hollow interior. An injection molded, plastic alignment spool is assembled into a central opening in the upper portion of the rotor shell and extends downwardly into the hollow interior. A cone-stack subassembly, including a plurality of individual separation cones which are injection molded out of plastic, are arranged into an aligned stack and positioned within the hollow interior and cooperatively assembled between the support hub and the alignment spool.

22 Claims, 28 Drawing Sheets

DISPOSABLE, SELF-DRIVEN CENTRIFUGE

REFERENCE TO RELATED APPLICATION

This application is a continuation-in-part patent application of U.S. Ser. No. 09/348,522, filed Jul. 7, 1999, now abandoned.

BACKGROUND OF THE INVENTION

The present invention relates in general to the design and construction of self-driven centrifugal separators with disposable component parts. More specifically, a first embodiment of the present invention relates to the design and construction of a self-driven, cone-stack centrifuge wherein the entire cone-stack assembly and rotor shell combination is designed to be disposable, including the structural configuration as well as the selected materials. In a related embodiment, all of the disposable-design features are retained, but the cone-stack subassembly is removed.

The evolution of centrifugal separators, self-driven centrifuges, and cone-stack centrifuge configurations is described in the Background discussion of U.S. Pat. No. 5,637,217 which issued Jun. 10, 1997 to Herman, et al. The invention disclosed in the '217 Herman patent includes a bypass circuit centrifuge for separating particulate matter out of a circulating liquid which includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly. A pair of oppositely disposed tangential flow nozzles in the base plate are used to spin the centrifuge within the cover so as to cause particulate matter to separate out from the liquid. The interior of the centrifuge bowl includes a plurality of truncated cones which are arranged into a stacked array and are closely spaced so as to enhance the separation efficiency. The incoming liquid flow exits the centertube through a pair of fluid (typically oil) inlets and from there is directed into the stacked array of cones. In one embodiment, a top plate in conjunction with ribs on the inside surface of the centrifuge bowl accelerate and direct this flow into the upper portion of the stacked array. In another embodiment of the '217 invention the stacked array is arranged as part of a disposable subassembly. In each embodiment, as the flow passes through the channels created between adjacent cones, particle separation occurs as the liquid continues to flow downwardly to the tangential flow nozzles.

While this prior patent discloses a disposable subassembly, this subassembly does not include the rotor top shell or what is called the permanent centrifuge bowl 197 in the '217 patent, nor the rotor bottom shell or what is called the base 198 in the '217 patent. Accordingly, in order to actually dispose of subassembly 186 (referring to the '217 patent), the subassembly must be disassembled from within the rotor shell. In contrast, in one embodiment of the present invention, the entire cone-stack subassembly, as well as the alignment spool, hub, and rotor shell, are all combined into a single, disposable unit. In another embodiment of the present invention, the entire cone-stack subassembly, as well as the spool, hub, rotor shell and both bearings are combined into a single disposable unit.

Earlier products based on the '217 patent utilize a non-disposable metallic rotor assembly and an internal disposable cone-stack capsule. While these products provide high performance and low life-cycle cost to the end user, there are areas for improvement which are addressed by the present invention. These areas for improvement which are addressed by the present invention include:

1. High initial cost of the centrifuge rotor assembly which consists of an aluminum die-cast rotor, machined steel hub, pressed in journal bearings, two machined nozzle jets, the cone-stack subassembly or capsule, deep-drawn steel rotor shell, O-ring seal, and a large machined "nut" to hold everything together. This design approach is best suited for large engines with a displacement of something greater than 19 liters where the initial cost of the centrifuge (and engine) is less important that life-cycle cost. Also, the larger rotor size, coupled with low production volume of these engines leads towards the use of metallic components and the corresponding manufacturing processes.

2. Awkward and time-consuming service. The centrifuge rotor must be disassembled to remove the cone-stack capsule which is a rather messy job to perform, despite the encapsulation of the cone-stack subassembly and the accumulated sludge. With a disposable rotor design, the complete rotor is simply lifted off of the shaft, discarded, and replaced with a new centrifuge rotor assembly.

The disposable centrifuge rotor design of the present invention provides the needed improvements to the problem areas listed above by reducing the initial cost of the rotor subassembly by approximately 75% ($6.00 versus $25.00 for comparably sized rotor of prior design) and by allowing quick and mess-free service. While a majority of the invention disclosure, as set forth herein, is directed to the embodiment that uses a cone-stack subassembly for enhanced separation efficiency, a lower-cost embodiment is also disclosed.

The molded plastic and plastic welded design of the rotor shell of the present invention in combination with the cone-stack subassembly provides improved separation performance compared to all-metal designs. The present invention also provides an incinerable product which is important for European markets. In a related embodiment of the present invention, top and bottom bearings are pressed into the top and bottom rotor shell halves, respectively. These bearings can be oil-impregnated sintered brass, machined brass, or molded plastic. The rotor shell of the present invention also provides a design improvement due to a reduced number of parts which results from the integration offered by molding as compared to metal-stamping designs. The present invention is intended primarily for lube system applications in diesel engines with displacement less than 19 liters. It is also believed that the present invention will have applications in hydraulic systems, in industrial applications such as machining fluid clean up, and in any pressurized liquid system where a high capacity and high efficiency bypass separator is desired.

SUMMARY OF THE INVENTION

A disposable, self-driven centrifuge rotor assembly for separating an undesired constituent out of a circulating fluid according to one embodiment of the present invention comprises a first rotor shell portion, a second rotor shell portion joined to the first rotor shell portion so as to define a hollow interior, a support hub positioned within the hollow interior adjacent the second rotor shell portion, an upper alignment spool positioned within the hollow interior adjacent the first rotor shell portion, and a cone-stack subassembly including a plurality of individual separation cones arranged into an aligned stack with flow spacing between adjacent separation cones, the cone-stack subassembly being positioned within the hollow interior between the support hub and the upper alignment spool.

One object of the present invention is to provide an improved self-driven, centrifuge rotor assembly.

Related objects and advantages of the present invention will be apparent from the following description.

DESCRIPTION OF THE PREFERRED EMBODIMENT

Figure 1:
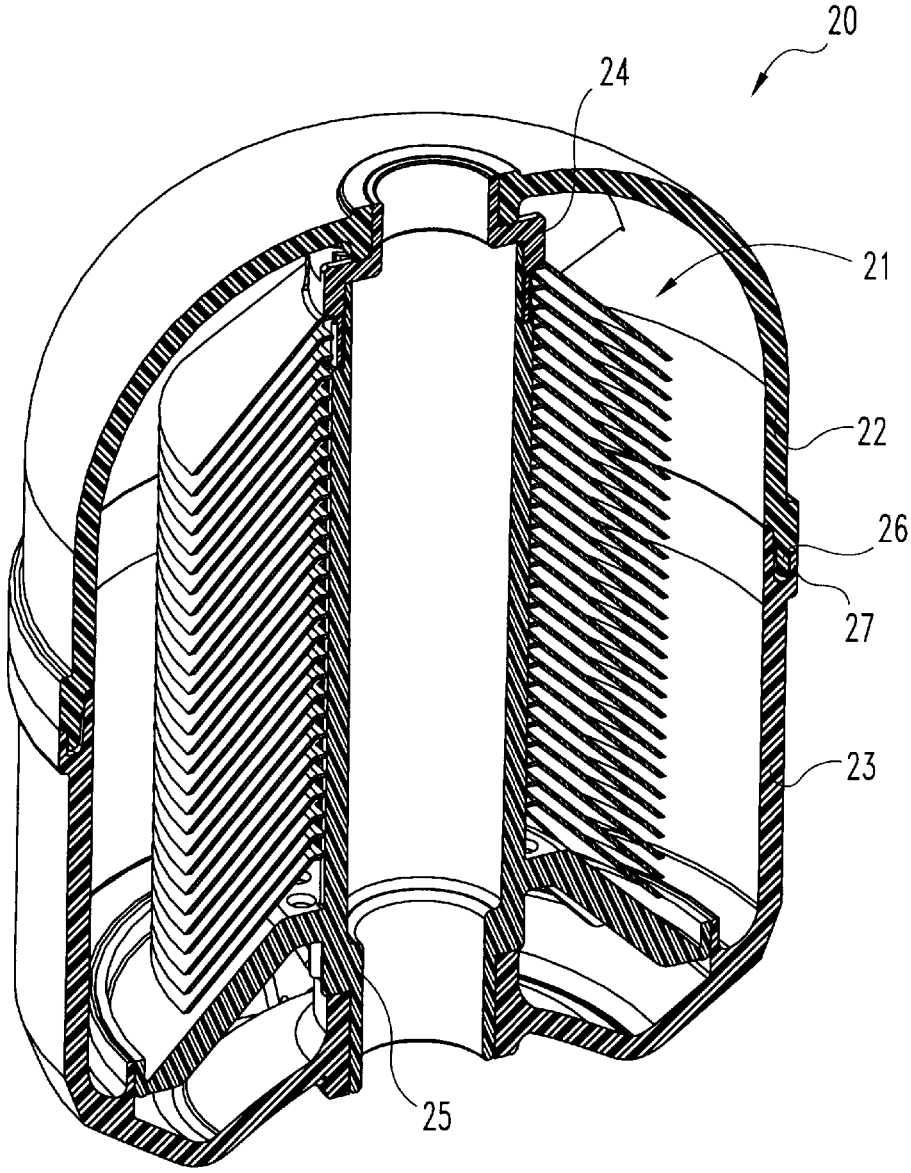
FIG. 1 is a perspective view of a disposable, self-driven centrifuge assembly according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
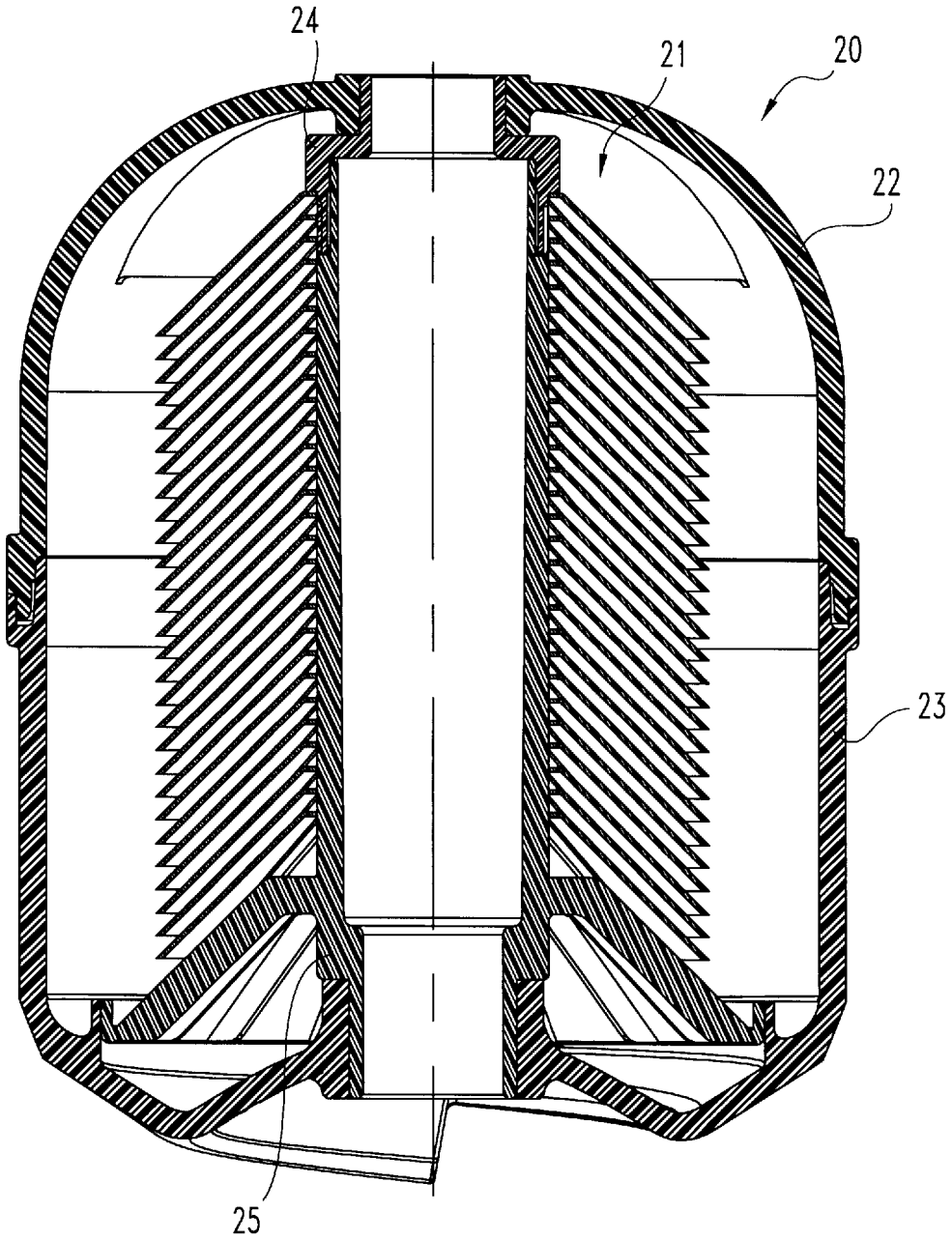
FIG. 2 is a front elevational view in full section of the FIG. 1 centrifuge assembly based on a first cutting plane.
Figure 3:
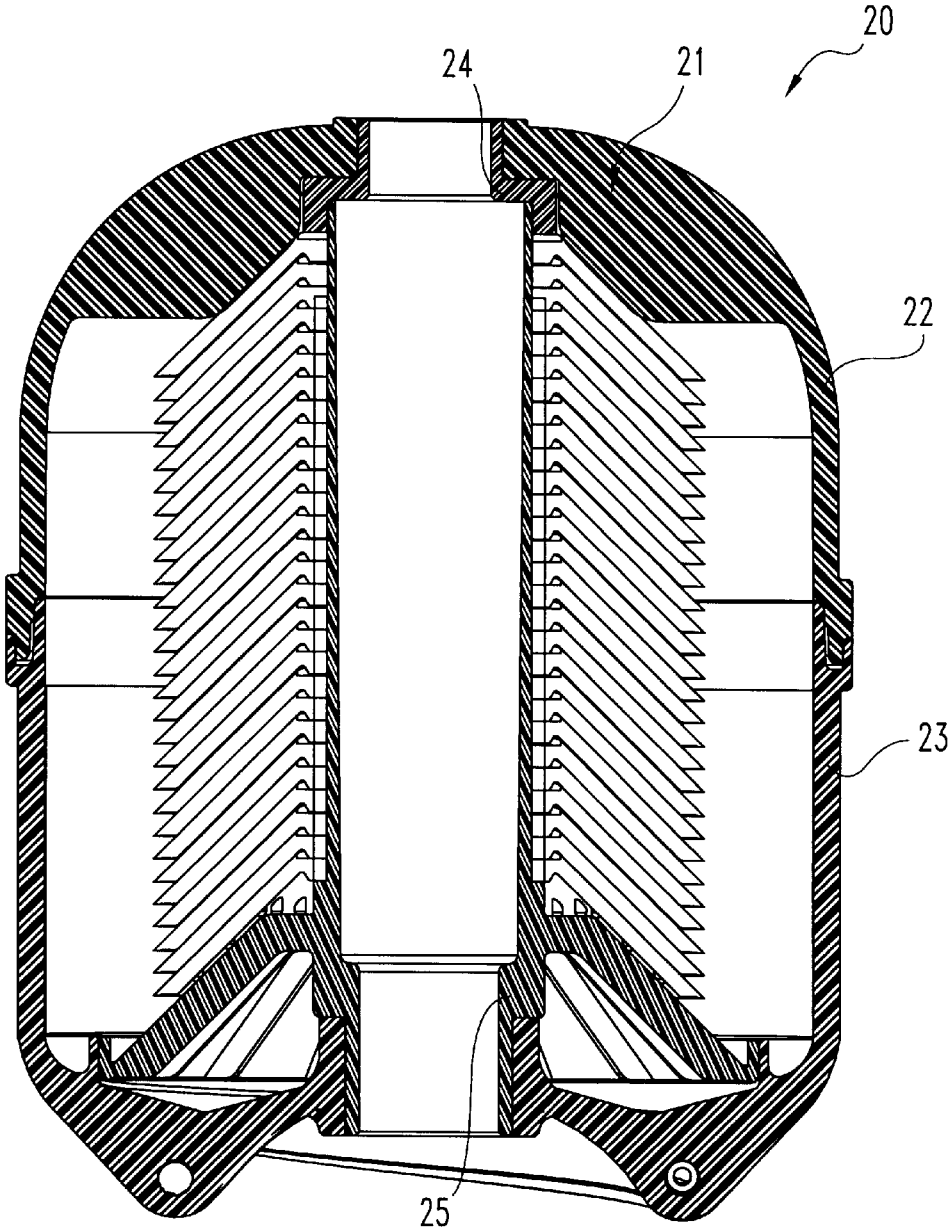
FIG. 3 is a front elevational view in full section of the FIG. 1 centrifuge assembly based on a second cutting plane.

Referring to FIGS. 1, 2, and 3, there is illustrated a first embodiment of the present invention which includes a disposable, self-driven, cone-stack centrifuge assembly 20. Assembly 20 includes five injection molded plastic components, counting the cone-stack subassembly 21 as one component. The remaining components include the rotor top shell 22, the rotor bottom shell 23, a top alignment spool 24, and hub 25. The rotor top shell 22 and rotor bottom shell 23 are joined together into an integral shell by means of an "EMA Bond" weld at the lower annular edge 26 of shell 22 and the upper annular edge 27 of shell 23. The material and technique for the EMA Bond weld are offered by EMA Bond Systems, Ashland Chemicals, 49 Walnut Street, Norwood, N.J.

Figure 2A:
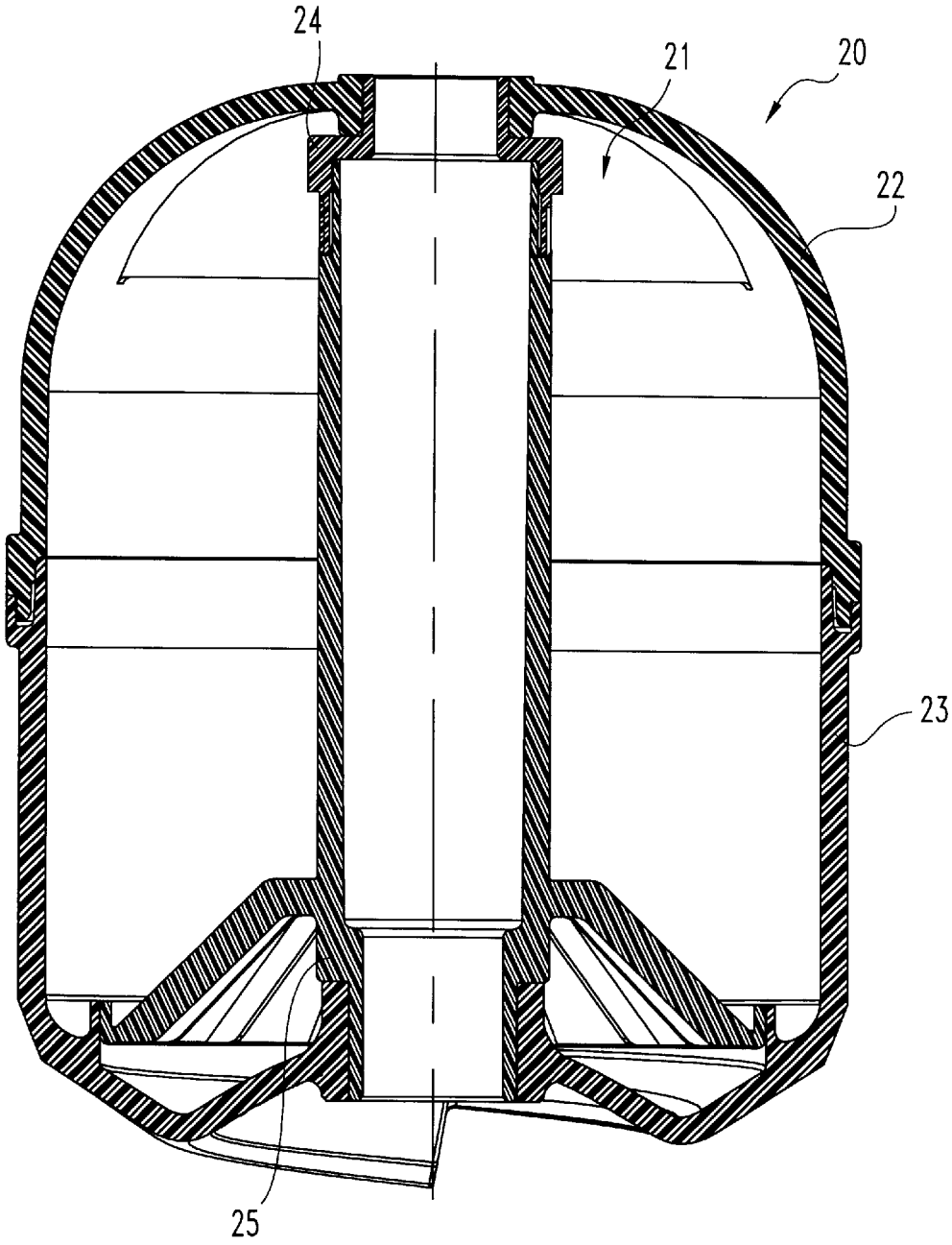
FIG. 2A is a front elevational view in full section of an alternative centrifuge assembly embodiment according to the present invention.

The FIG. 2A illustration shows the first embodiment of the present invention without the cone-stack subassembly 21. While keeping all other components virtually identical, but simply removing the individual cones 71, a lower-cost version of the present invention is created. The FIG. 2A embodiment still functions in the matter described for the FIGS. 1, 2, and 3 embodiment as far as the remaining components. The only difference is the elimination of the cone-stack subassembly 21. By keeping the rotor top shell 22, the rotor bottom shell 23, the top alignment spool 24, and the hub 25 of FIG. 2A virtually identical to the corresponding components of FIGS. 1, 2, and 3, the cone-stack subassembly can be added or deleted as an option at the time of final assembly before the two rotor shells are welded together.

Figure 4:
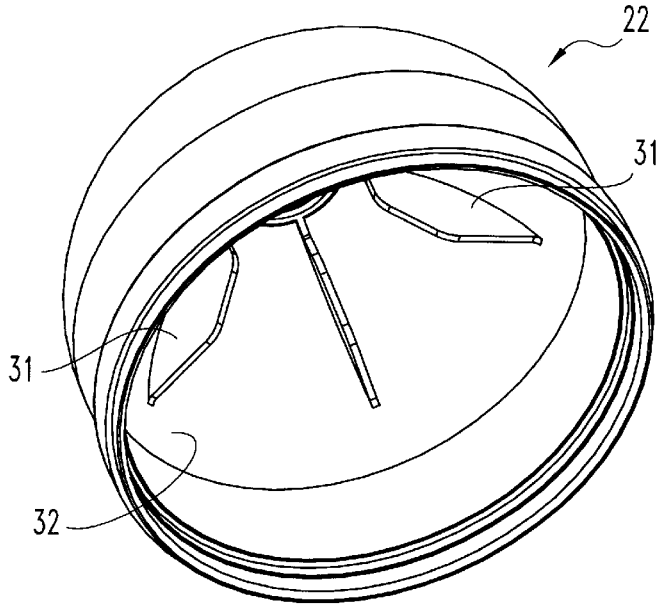
FIG. 4 is a perspective view of a rotor top shell which comprises one component of the FIG. 1 centrifuge assembly.
Figure 5:
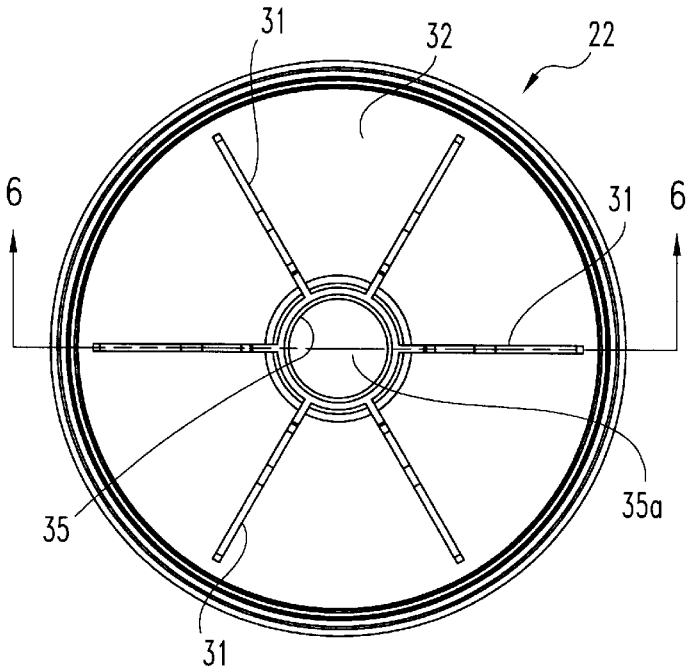
FIG. 5 is a bottom plan view of the FIG. 4 rotor top shell.
Figure 6:
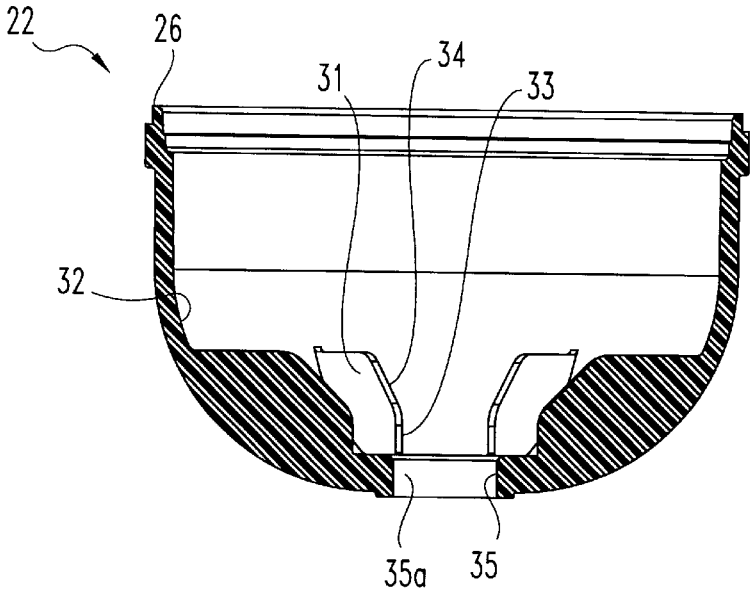
FIG. 6 is a front elevational view in full section of the FIG. 4 rotor top shell as viewed along cutting plane 6—6 in FIG. 5.
Figure 7:
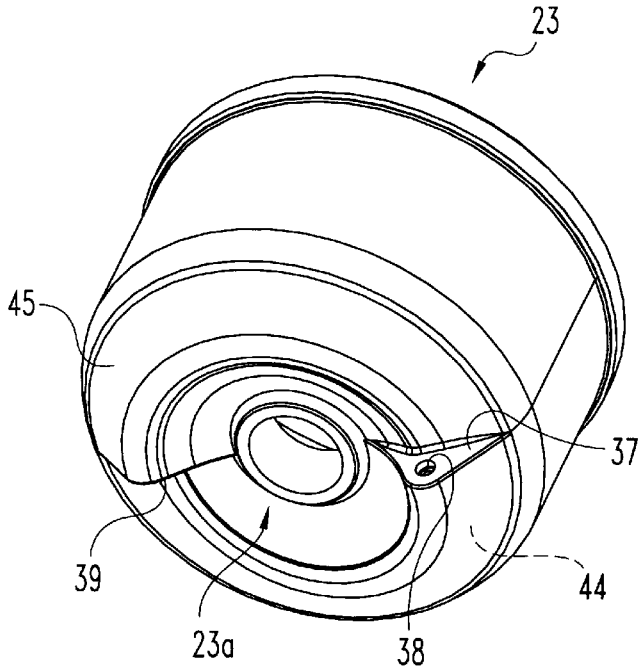
FIG. 7 is a perspective view of a rotor bottom shell which comprises one component of the FIG. 1 centrifuge assembly.
Figure 8:
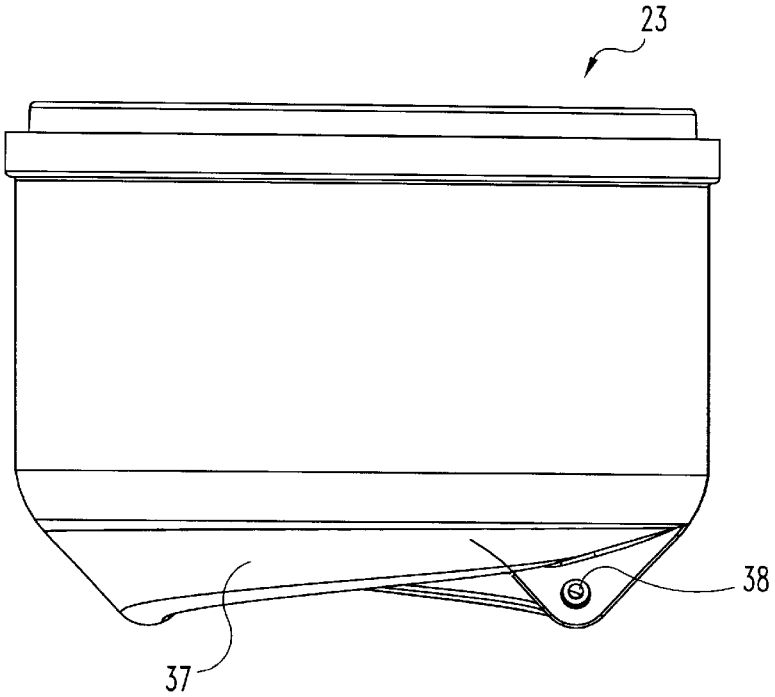
FIG. 8 is a front elevational view of the FIG. 7 rotor bottom shell.
Figure 9:
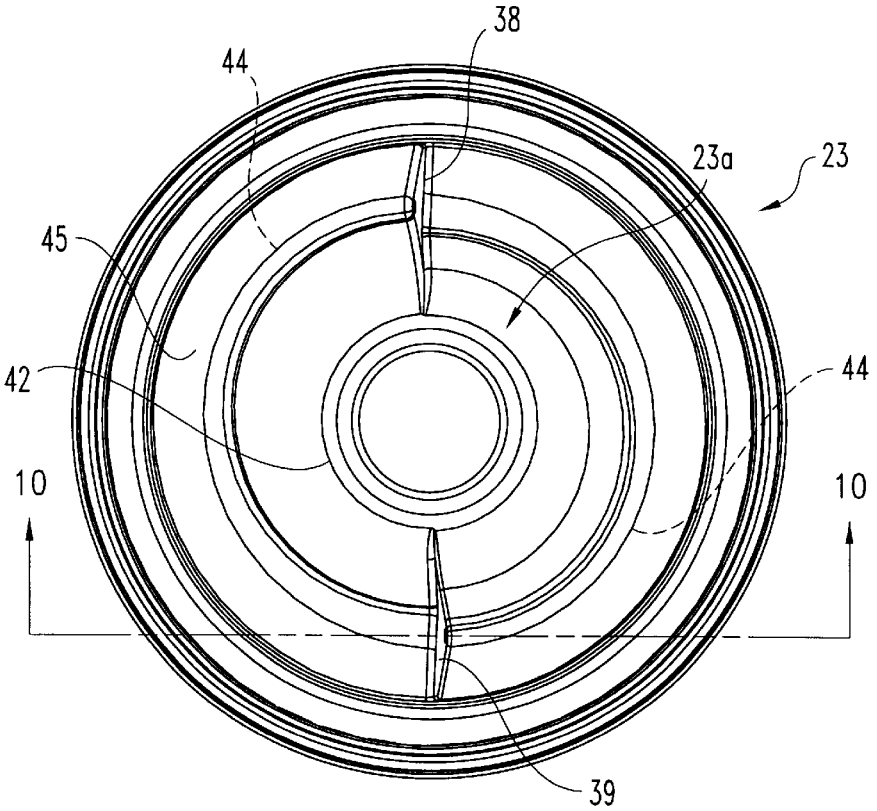
FIG. 9 is a bottom plan view of the FIG. 7 rotor bottom shell.
Figure 10A:
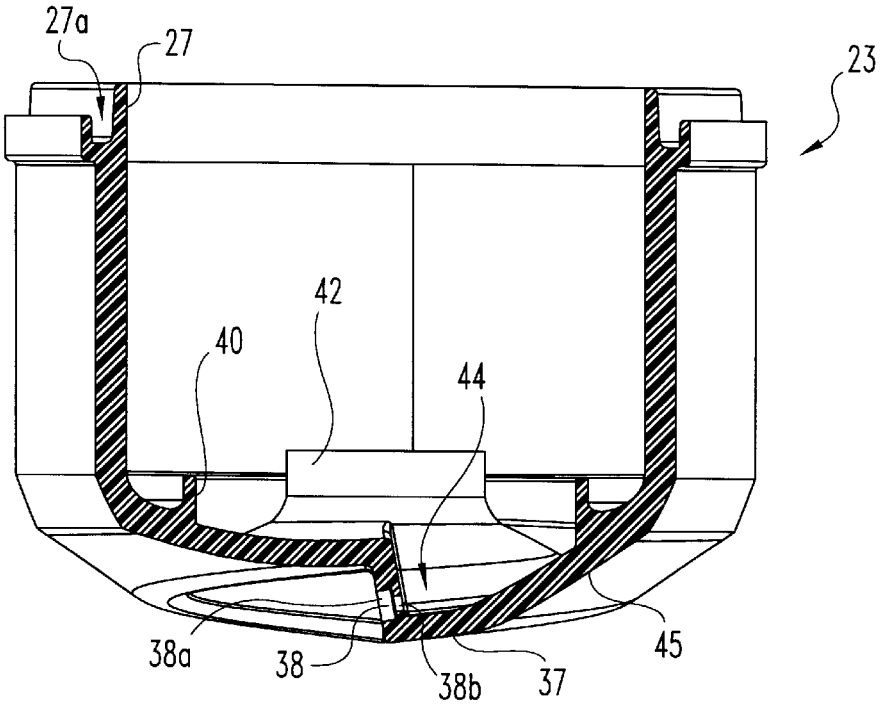
FIG. 10A is a front elevational view in full section of the FIG. 7 rotor bottom shell as viewed along cutting plane 10—10 in FIG. 9 and rotated 180 degrees.
Figure 10B:
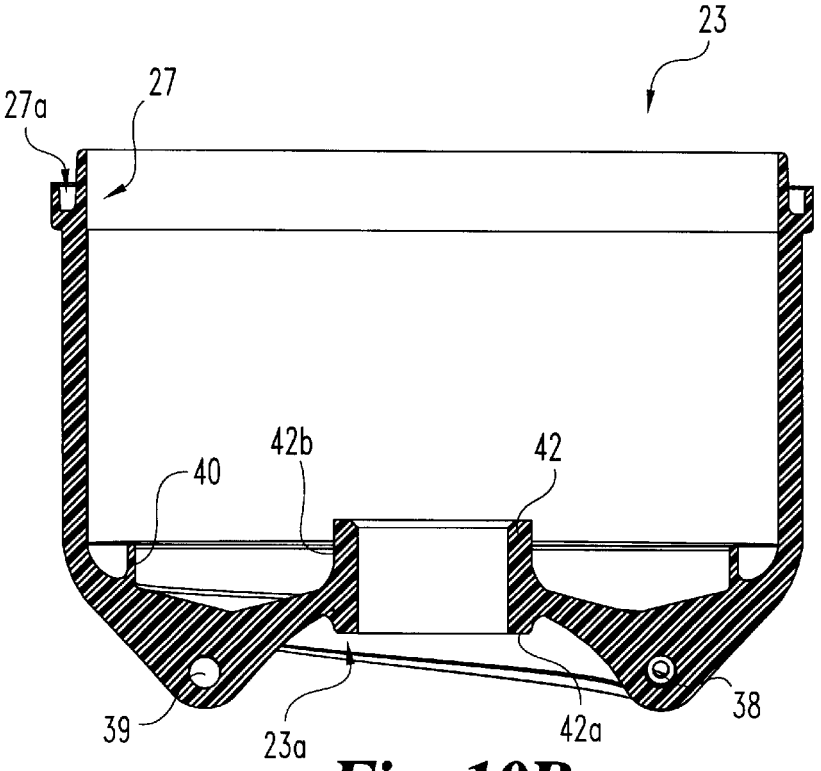
FIG. 10B is a front elevational view in full section of the FIG. 7 rotor bottom shell.

The rotor top shell 22 is illustrated in FIGS. 4, 5, and 6 and is constructed and arranged to provide a sludge containment vessel, suitable to handle the range of internal pressures which will be present, when welded together with the rotor bottom shell 23. Top shell 22 includes six equally-spaced integral acceleration vanes 31 which provide radial flow channels that direct liquid to inlet holes positioned in each cone. The vanes are integrally molded to the inner surface of outer wall 32.

The six vanes 31 are used to impart acceleration to the liquid and thus prevent "slip" of the liquid with respect to the spinning centrifugal rotor assembly 20. Each of the vanes 31 includes an axial edge 33 which extends into an approximate 45 degree outwardly radiating edge 34. The set of six 45 degree vane edges are constructed and arranged for establishing proper engagement with the top surface of the cone-stack subassembly 21. The outer wall 32 defines cylindrical sleeve 35 which defines cylindrical opening 35*a* which is concentric with lower circular edge 26. Lower edge 26 and upper edge 27 are cooperatively configured with a tongue and groove relationship for induction welding together the corresponding two shell portions. Top shell 22 provides the tongue portion and bottom shell 23 provides the groove portion. While the preferred welding technique employs the technology known as EMA Bond™, alternative welding and joining techniques are envisioned. For example, the two shell portions can be joined together into the integral shell which encloses the cone-stack subassembly 21 by means of spin-welding, ultrasonic welding or induction welding.

The rotor bottom shell 23 is illustrated in FIGS. 7, 8, 9, 10A, and 10B and is constructed and arranged to provide a sludge containment vessel, suitable to handle the range of internal pressures which will be present, when welded together with the rotor top shell 22. The lower portion 37 of bottom shell 23 includes molded-in nozzle jet 38 and 39 with an oversized "relief" area 23*a* to maximize jet velocity (and rotor angular speed). Each nozzle jet 38 and 39 is shaped with a counterbore, see 38*a*, such that the smaller diameter hole, see 38*b*, through the plastic can be kept relatively short in length. A shorter length in relation to the diameter helps to maintain the desired discharge jet velocity and thus rotor speed. Hollow cylindrical sleeve 42 is concentric with upper annular edge 27 and centered symmetrically between nozzle jets 38 and 39. Sleeve 42 includes a short extension 42*a* that extends beyond the defining surface of the relief area 23*a*. Sleeve 42 also includes a longer extension 42*b* that extends into the hollow interior of rotor bottom shell 23. Once the two rotor portions are welded together, sleeve 42 is concentric with opening 35 a.

The internal annular ring-like wall 40 provides a mating engagement surface for the outside diameter of annular wall 41 of hub 25 (see FIGS. 11–14). Walls 40 and 41 are concentrically telescoped together into tight engagement in order to create a sealed interface and prevent any fluid flow from bypassing the cone stack. The sealed interface can be created by either an interference fit between or by welding together plastic walls 40 and 41. The upper edge 27 is configured with a receiving grove 27*a* which provides the cooperating portion of the tongue and groove connection with lower edge 26.

A further feature of rotor bottom shell 23 is the presence of a helical "V"-shaped ramp 44 which is molded as part of lower surface 45. Ramp 44 guides the liquid flow smoothly toward the two nozzle jets 38 and 39 and minimizes drag from air and splash (or spray) on the rotor exterior, and provides a strong structural configuration to withstand fluid pressure.

The hub 25 is illustrated in FIGS. 11, 12, 13, and 14 and is constructed with a conical base 48 and an integral tube 49 which extends through the conical base such that a first cylindrical tube portion 50 extends outwardly from one side of base 48 and a second cylindrical tube portion 51 extends from the opposite side of base 48. At the outermost edge 52 of base 48, the vertical annular wall 41 is located. Second tube portion 51 fits closely into sleeve 42 as illustrated in FIG. 1.

The first tube portion 50 has a substantially cylindrical shape and extends axially upwardly into the center of the cone-stack subassembly 21. The outside diameter surface 50*a* of first tube portion 50 includes two axially-extending radial projections 53 and 54 which act as alignment keys that interfit with inside diameter notches in each cone of the cone-stack subassembly.

The top surface or upper edge of each projection 53 and 54 includes a concave (recessed) notch 58 which is constructed and arranged to interfit with a cooperating projection on the tip of each finger of the alignment spool 24. The alignment spool 24 is illustrated in FIGS. 18–21 and described hereinafter. As will be explained, the spool 24 includes six equally-spaced, depending fingers, each of which have a distal edge which includes a convex projection. The size and shape of each convex projection is compatible with each notch 58 (two total, 180 degrees apart) such that any two projections which are 180 degrees apart interfit down into the two (recessed) notches 58. This interfit is designed to create a mating relationship between the alignment spool 24 and the hub 25. This in turn insures proper tangential alignment of the entire cone-stack subassembly 21, even if the cone-stack is "loose" which could be caused by a missing cone or a tolerance stack up problem.

The inside diameter surface 59 of the second tube portion 51 provides a journal bearing surface for rotation upon the shaft of the centrifuge. As would be understood, the second tube portion 51 is substantially cylindrical. One option for this portion of the design is to use this inside diameter surface for receipt of a metallic bushing. The diameter size can be reamed to the proper dimension if this option is selected. However, consistent with attempting to make the entire assembly incinerable for the European market, an all-plastic construction is preferred.

The conical base (or skirt) 48 of hub 25 provides an axial support surface for the cone-stack subassembly and incorporates molded-in outlet holes 60 which provide for flow out of the cone-stack subassembly 21. Each cone includes an inside diameter edge with six equally-spaced recessed notches. While two of the six notches which are 180 degrees apart are used to align each cone onto the first two portions 50, the remaining four notches represent available flow passageways. The outlet holes 60 are arranged in an equally-spaced circular pattern (16 total) and are located beneath the cone notches.

Figure 11:
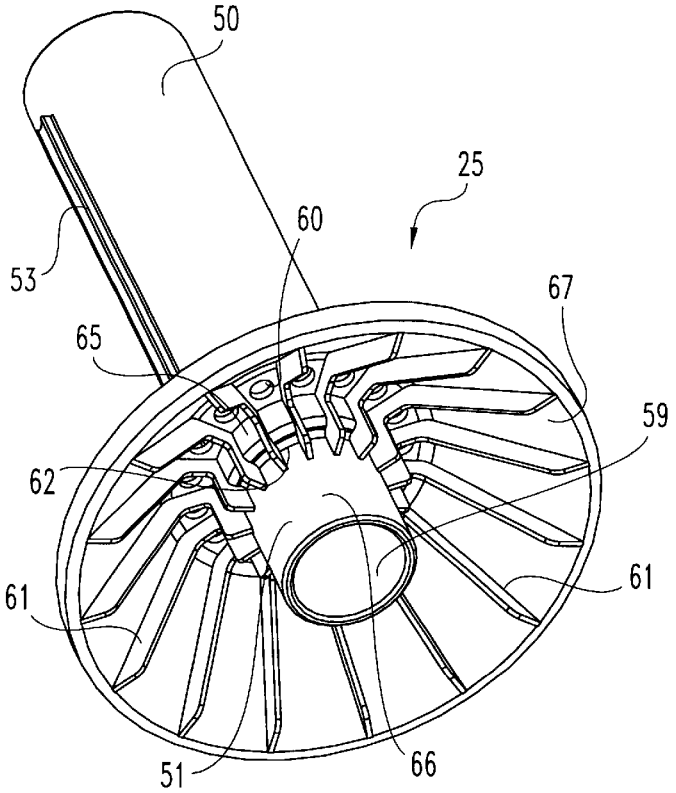
FIG. 11 is a perspective view of a hub which comprises one component of the FIG. 1 centrifuge assembly.
Figure 12:
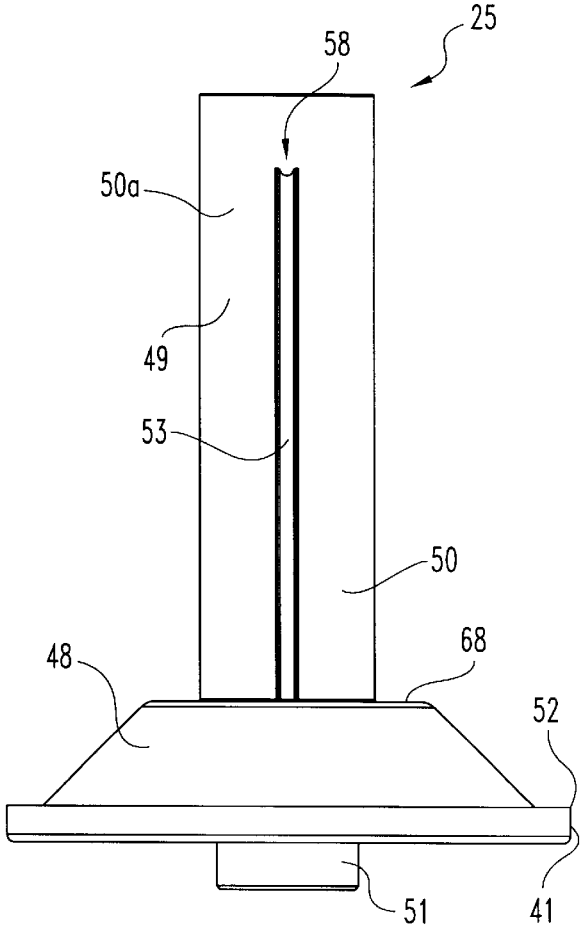
FIG. 12 is a front elevational view of the FIG. 11 hub.
Figure 13:
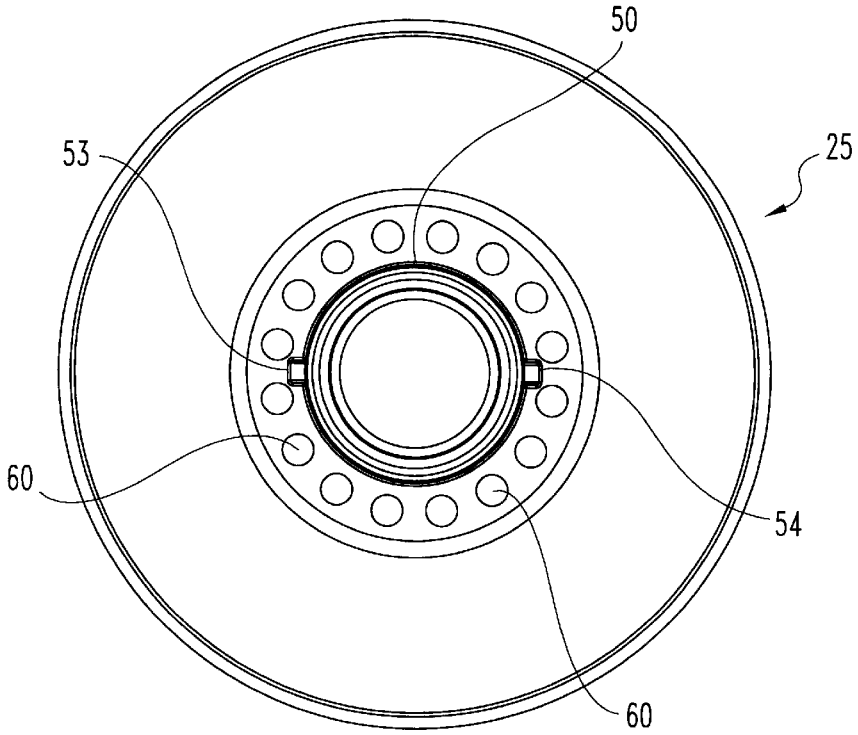
FIG. 13 is a top plan view of the FIG. 11 hub.
Figure 14:
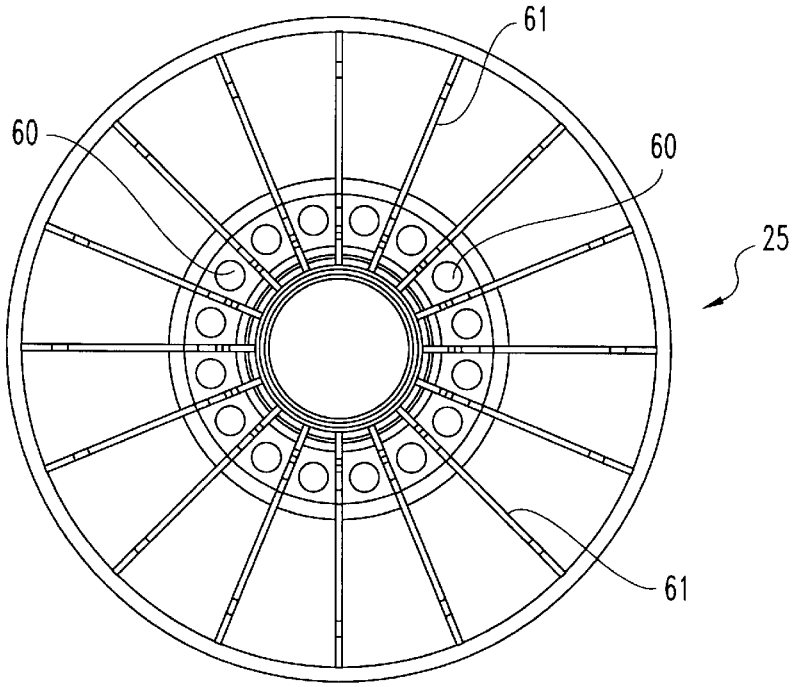
FIG. 14 is a bottom plan view of the FIG. 11 hub.

The underside of the conical base 48 is reinforced by sixteen radial webs 61 which are equally-spaced and located between each pair of adjacent outlet holes 60. Each web 61 is centered between the corresponding two outlet holes 60 as is illustrated in FIG. 14. The general curvature, geometry, and shape of each web and its integral construction as a unitary part of hub 25 and conical base is illustrated in FIG. 11. The radial web 61 on the underside of base 48 is provided to help reduce long-term creep of the base 48, due to any pressure gradient between the "cone side" and the rotor base side of the conical surface, which can occur in high temperature environments during sustained operation.

As is illustrated in FIG. 11, the second tube portion 51 includes an offset ledge or shoulder 62 which reduces the inside diameter size as well as the outside diameter size of the second tube portion. Effectively, this shoulder 62 means that the second tube portion has a first larger section 65 and a second smaller section 66. The webs are shaped so as to be integrally joined to both sections 65 and 66 and to the shoulder 62. The opposite end, outer portion of each web is integral with the inside surface 67 of conical base 48. Upper surface 68 of base 48 which is integral with the first tube portion 50 and with the second tube portion 51 actually defines the line of separation between the first tube portion 50 and the second tube portion 51.

Figure 15:
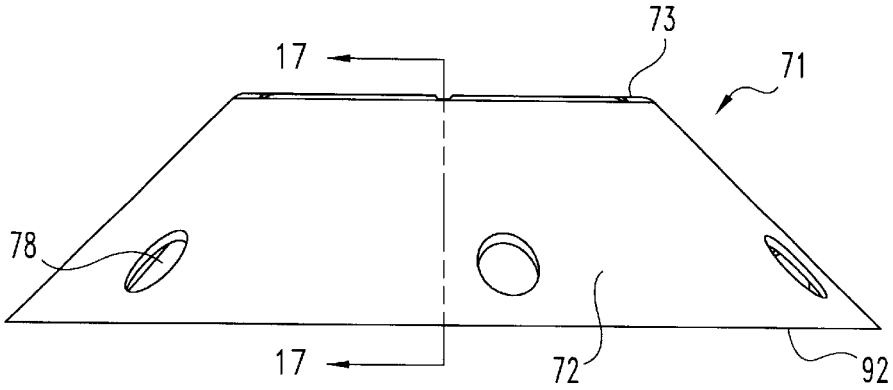
FIG. 15 is a front elevational view of a cone which comprises part of a cone-stack subassembly which comprises one component of the FIG. 1 centrifuge assembly.
Figure 16:
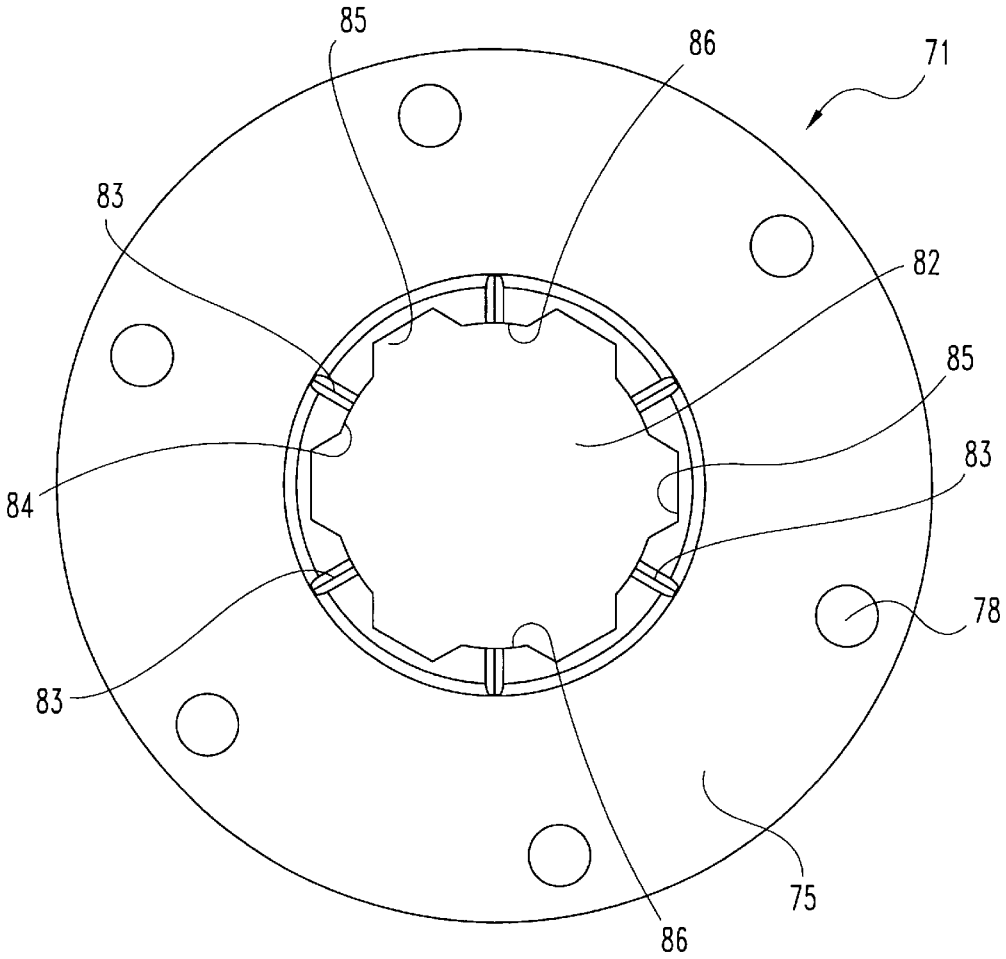
FIG. 16 is a top plan view of the FIG. 15 cone.
Figure 17:
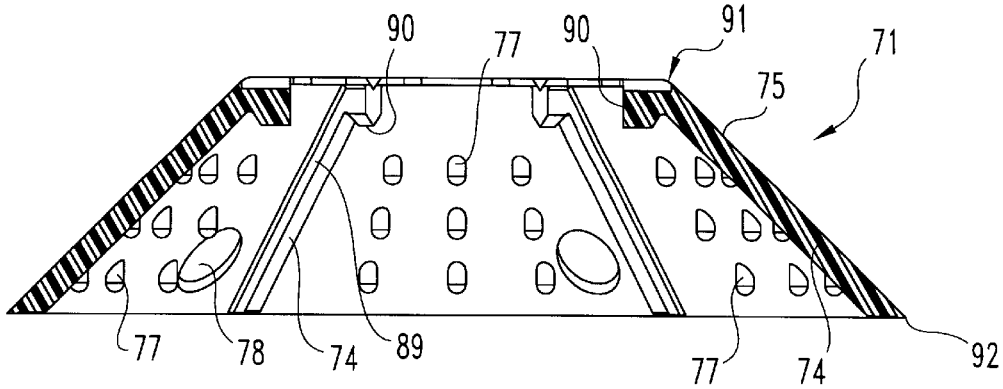
FIG. 17 is a front elevational view in full section of the FIG. 15 cone as viewed along cutting plane 17—17 in FIG. 15.
Figure 18:
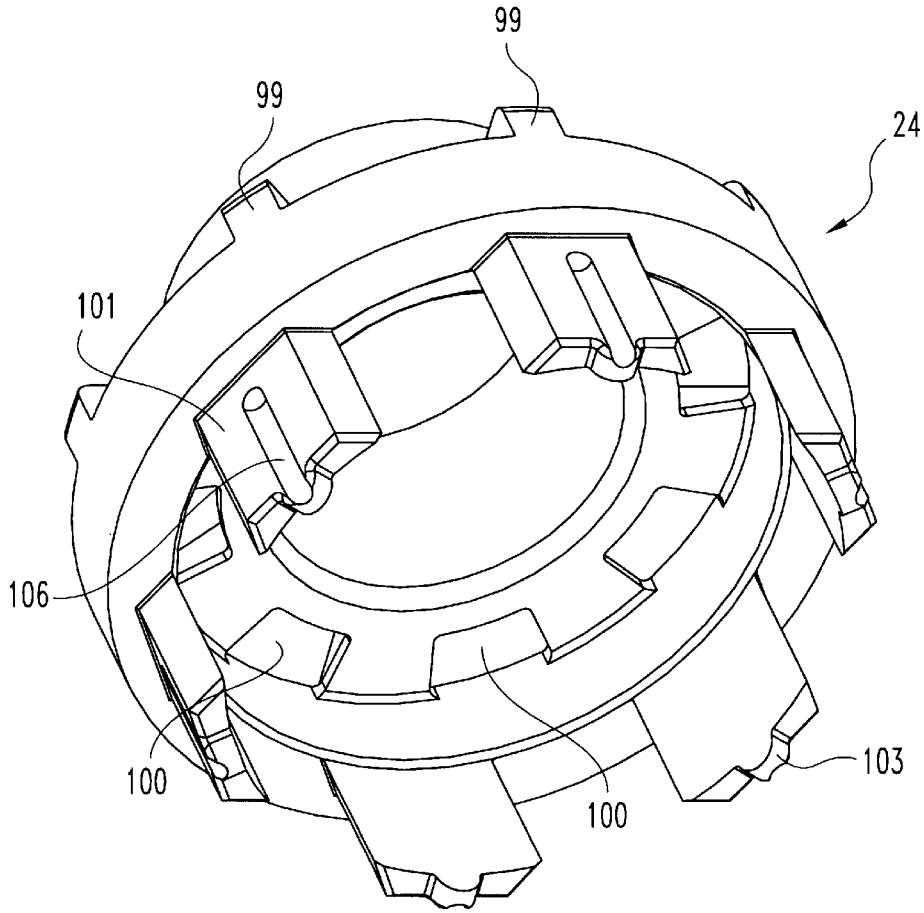
FIG. 18 is a perspective view of an alignment spool which comprises one component of the FIG. 1 centrifuge assembly.
Figure 19:
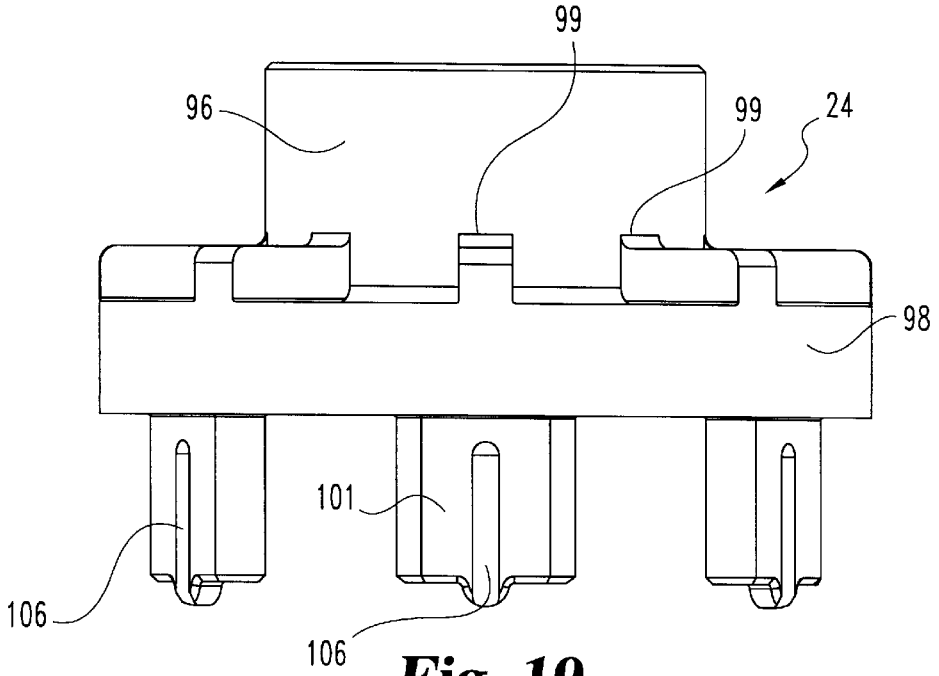
FIG. 19 is a front elevational view of the FIG. 18 alignment spool.
Figure 20:
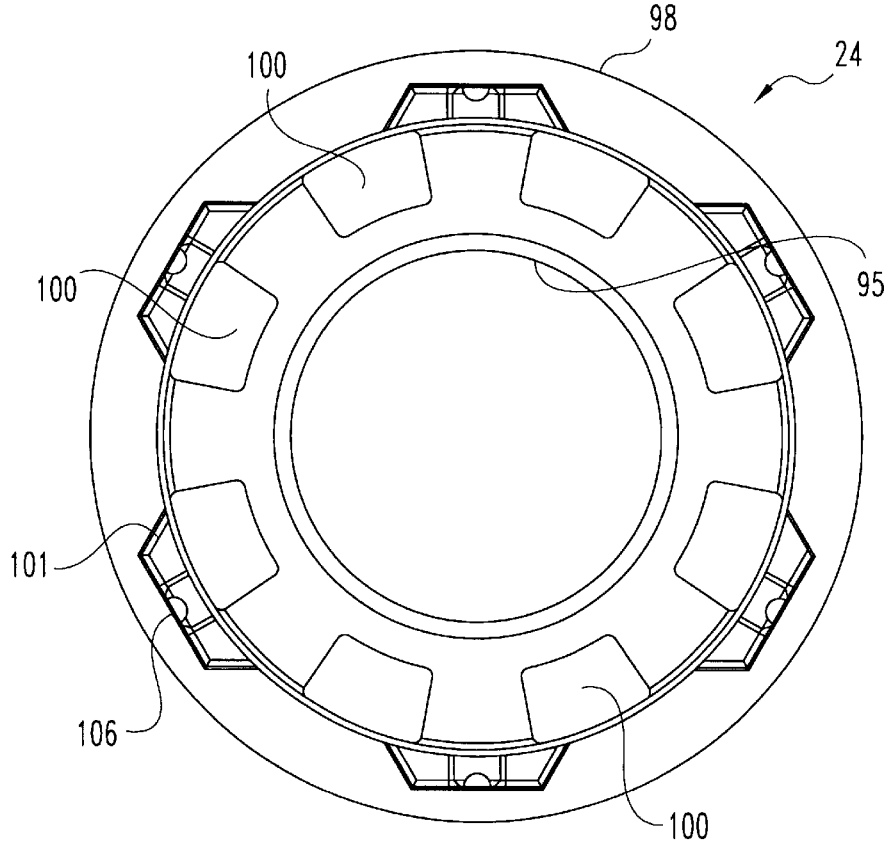
FIG. 20 is a bottom plan view of the FIG. 18 alignment spool.
Figure 21:
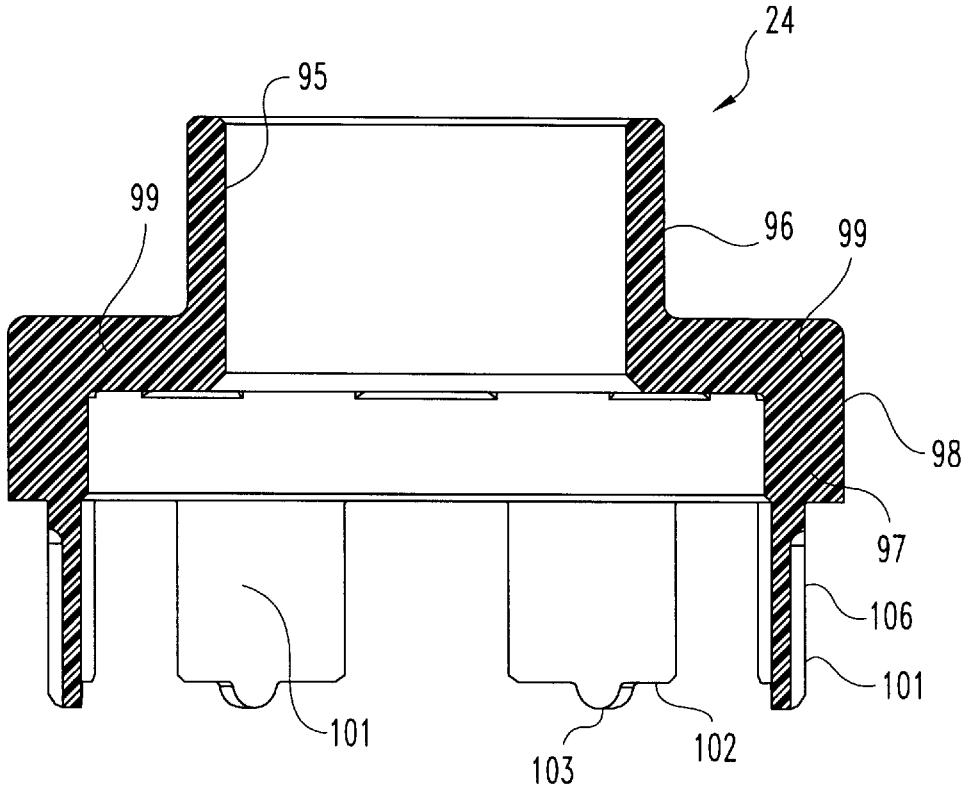
FIG. 21 is a front elevational view in full section of the FIG. 18 alignment spool.

With reference to FIGS. 15, 16, and 17, one of the individual cones 71 which comprise the cone-stack subassembly is illustrated. In the preferred embodiment, a total of twenty-eight cones 71 are aligned and stacked together in order to create cone-stack subassembly 21. However, virtually any number of cones can be used for the cone-stack subassembly depending on the size of the centrifuge, the type of fluid, and the desired separation efficiency. Each cone 71 is constructed and arranged in a manner virtually identical to the cone described and illustrated in U.S. Pat. No. 5,637,217, which issued Jun. 10, 1997 to Herman, et al.

Each cone 71 is a frustoconical, thin-walled plastic member including a frustoconical body 72, upper shelf 73, and six equally-spaced vanes 74 which are formed on the inner surfaces of body 72 and shelf 73. The outer surface 75 of each cone 71 is substantially smooth throughout, while the inner surface 76 includes, in addition to the six vanes 74, a plurality of projections 77 which help to maintain precise and uniform cone-to-cone spacing between adjacent cones 71. Disposed in body 72 are six equally-spaced openings 78 which provide the entrance path for the oil flow between adjacent cones 71 of the cone-stack subassembly 21. Each opening 78 is positioned adjacent to a different and corresponding one of the six vanes 74.

The upper shelf 73 of each cone 71 defines a centered and concentric aperture 82 and surrounding the aperture 82 in a radially-extending direction are six equally-spaced, V-shaped grooves 83 which are circumferentially aligned with the six vanes 74. The grooves 83 of one cone receive the upper portions of the vanes of the adjacent cone and this controls proper circumferential alignment for all of the cones 71 of the cone-stack subassembly 21. Aperture 82 has a generally circular edge 84 which is modified with six part-circular, enlarged openings 85. The openings 85 are equally-spaced and positioned midway (circumferentially) between adjacent vanes 74. The edge portions 86 which are disposed between adjacent openings 85 are part of the same part-circular edge with a diameter which is closely sized to the outside diameter of the first tube portion 50. The close fit of edge portions 86 to the first tube portion 50 and the enlarged nature of openings 85 means that the exiting flow of oil through aperture 82 is limited to flow through openings 85. As such, the exiting oil flow from cone-stack subassembly 21 is arranged in six equally-spaced flow paths along the outside diameter of the first tube portion 50.

Each of the vanes 74 are configured in two portions 89 and 90. Side portion 89 has a uniform thickness and extends from radiused corner 91 along the inside surface of body 72 down to annular edge 92. Each upper portion 90 of each vane 74 is recessed below and circumferentially centered on a corresponding V-shaped groove 83. Portions 90 function as ribs which notch into corresponding V-shaped grooves 83 on the adjacent cone 71. This groove and rib notching feature allows rapid indexing of the cone-stack subassembly 21. The assembly and alignment of the cones 71 into the cone-stack subassembly 21 is preferably achieved by first stacking the selected cones 71 together on a mandrel or similar tube-like object without any "key" feature. The alignment step of the cones 71 on this separate mandrel is performed by simply rotating the top or uppermost cone 71 until all of the cones notch into position by the interfit of the upper vane portions 90 into the V-shaped grooves 83. Once the entire cone-stack subassembly 21 is assembled and aligned in this fashion, it is then removed as a subassembly from the mandrel and placed over the hub 25. In this manner, the radial projections 53 and 54 which act as alignment keys will be in alignment with the inside diameter notches of each cone in the cone-stack subassembly 21.

The alignment spool 24 is illustrated in FIGS. 18, 19, 20, and 21 and is constructed and arranged to provide for rotation of the disposable centrifuge rotor assembly 20 on the centrifuge shaft. It is actually the inside diameter 95 of upper tube portion 96 which is cylindrical in form and concentric with body portion 97 which includes a substantially cylindrical outer wall 98. It is also envisioned that a metal bushing can be pressed into the inside diameter 95 of portion 96 in order to provide the journal bearing surface. Depending on the size of the selected metal bushing, the inside diameter 95 may need to be reamed to the proper dimension for the press fit. However, in order to have the entire assembly incinerable, a metal bushing would not be used and thus the preferred embodiment is an all-plastic construction. As illustrated in FIGS. 1–6, spool 24 is assembled into rotor top shell 22. In particular, the upper tube portion 96 fits within cylindrical opening 35.

The region of body portion 97 located between cylindrical outer wall 98 and inside diameter 95 includes eight equally-spaced and integrally molded radial ribs 99. Located between each pair of adjacent radial ribs 99 is a flow opening 100. In all, there are eight equally-spaced flow openings 100. The radial ribs 99 are in abutment with the lower annular edge of sleeve 35 and the flow openings 100 are in flow communication with the interior of hub 25, specifically the first and second tube portions 50 and 51. The abutting engagement between the spool 24 and rotor top shell 22 in cooperation with openings 100 creates radial flow passageways from the hub into the acceleration vane region of the centrifuge rotor assembly 20. The insertion of the upper tube portion 96 into opening 35*a* provides concentric alignment of the cone-stack subassembly 21.

Axially extending from the lower edge of the outer wall 98 in a direction away from tube portion 96 are six equally-spaced integrally molded fingers 101. The distal (lower) edge 102 of each finger 101 includes convex projection 103 which is constructed and arranged to fit within the concave (recessed) notch 58 in each projection 53 and 54.

Additionally, each finger 101 has a shape and geometry which corresponds to the flow openings 85 which are located in the circular edge 84 of aperture 82. The fit of the fingers into the flow opening 85 of the top or uppermost cone 71 of the cone-stack subassembly 21 is such that the flow openings 85 in the top cone are plugged closed. By plugging these flow openings closed, the design of the preferred embodiment prevents total flow bypass of the cone-stack subassembly. The inside surface of each finger 101 engages the outside diameter of the first tube portion 50, thereby holding the hub 25 in proper concentric alignment with the rotor top shell 22.

Since the molded fingers extend through more cones 71 than only the top cone, small recessed grooves 106 are formed into the radially-outer surface of each finger. These grooves 106 enable flow to occur through these other cones. Without the grooves 106, the "engaged" cones would represent a dead end to the flow and the affected cones would be of no value to the separation task.

The fabrication and assembly of the disposable centrifuge assembly 20 which has been described and is illustrated herein begins with the injection molded of the individual cones 71. As described, the style of each cone 71 used in the present invention is virtually identical to the style of cone detailed in U.S. Pat. No. 5,637,217. As described, this style of centrifuge cone includes its own self-alignment feature and is designed for automatically establishing the proper axial spacing between adjacent cones. The use of the V-groove and the V-rib interfit allows the cones to be stacked one on top of the other and then simply rotate the top cone until all of the cones "click in " to position.

The all plastic construction of this first embodiment of the present invention allows the assembly 20 to be disposed of in total or incinerated as a means of discarding without the need for any messy or complicated disassembly and without the need to exclude or salvage any metal parts.

Figure 22:
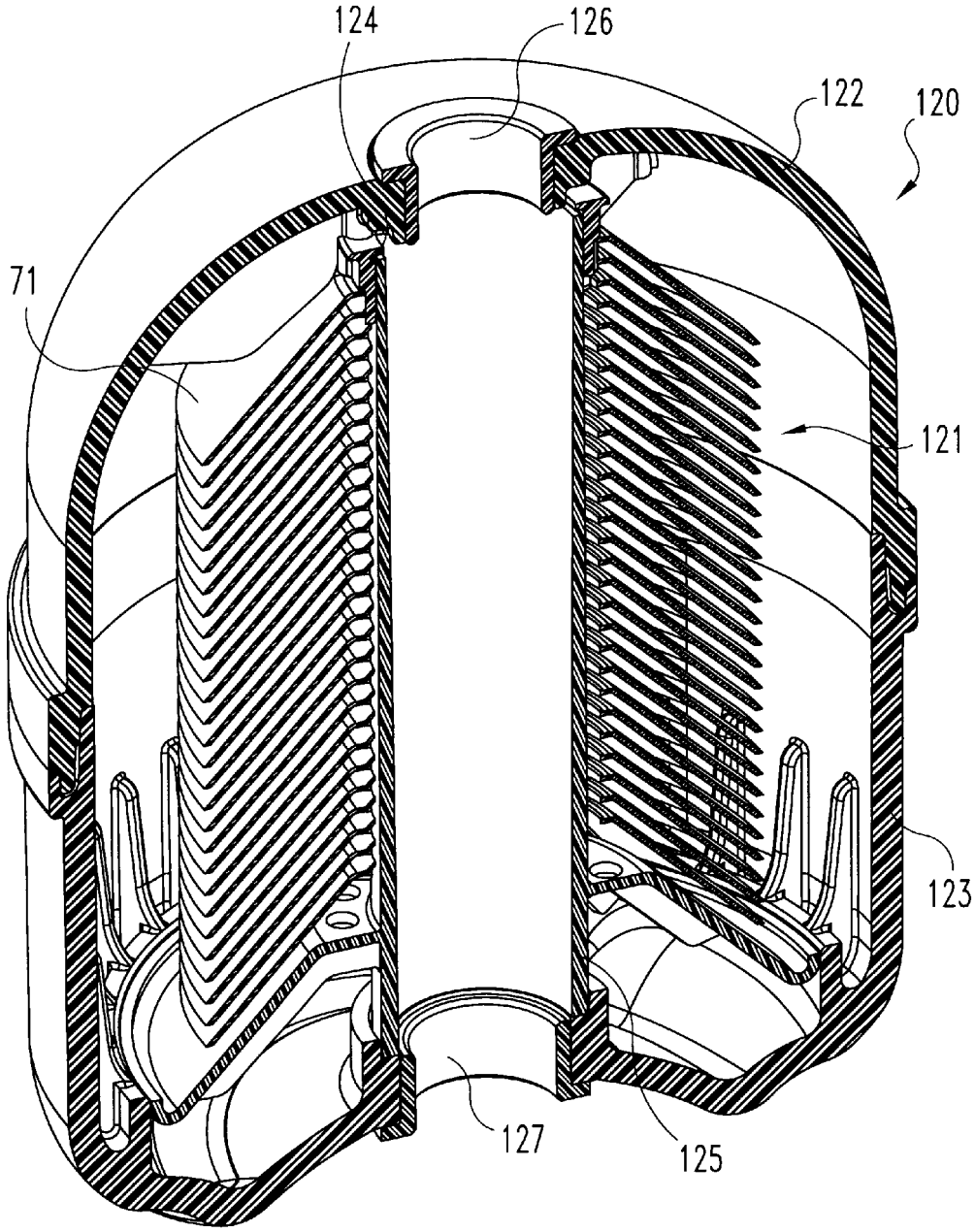
FIG. 22 is a fragmentary, front perspective view of a disposable, self-driven centrifuge assembly according to a typical embodiment of the present invention.

Referring to FIG. 22 there is illustrated (in partial section) another embodiment of the present invention which includes a disposable, self-driven, cone-stack centrifuge assembly 120. Assembly 120 includes five injection molded plastic components, counting the cone-stack subassembly 121 as one component. The remaining molded plastic components include the rotor top shell 122, the rotor bottom shell 123, an upper alignment spool 124, and hub 125. Also included as assembled parts of this embodiment of the present invention are upper bearing 126 and lower bearing 127. All of these components are illustrated in an exploded view form in FIG. 23. The cone-stack subassembly 121 includes a stacked assembly of individual cones 71.

The centrifuge assembly 120 embodiment of FIG. 22 is similar in many respects to the centrifuge assembly 20 embodiment of FIGS. 1–21, including the use of a stacked series of cones 71. While the construction and functioning of these two centrifuge assemblies 20 and 120 are similar in many respects, there are also certain design changes. These design changes will be described in detail with the understanding that virtually all other aspects of the two centrifuge assembly embodiments, as described herein, are substantially the same.

Figure 23:
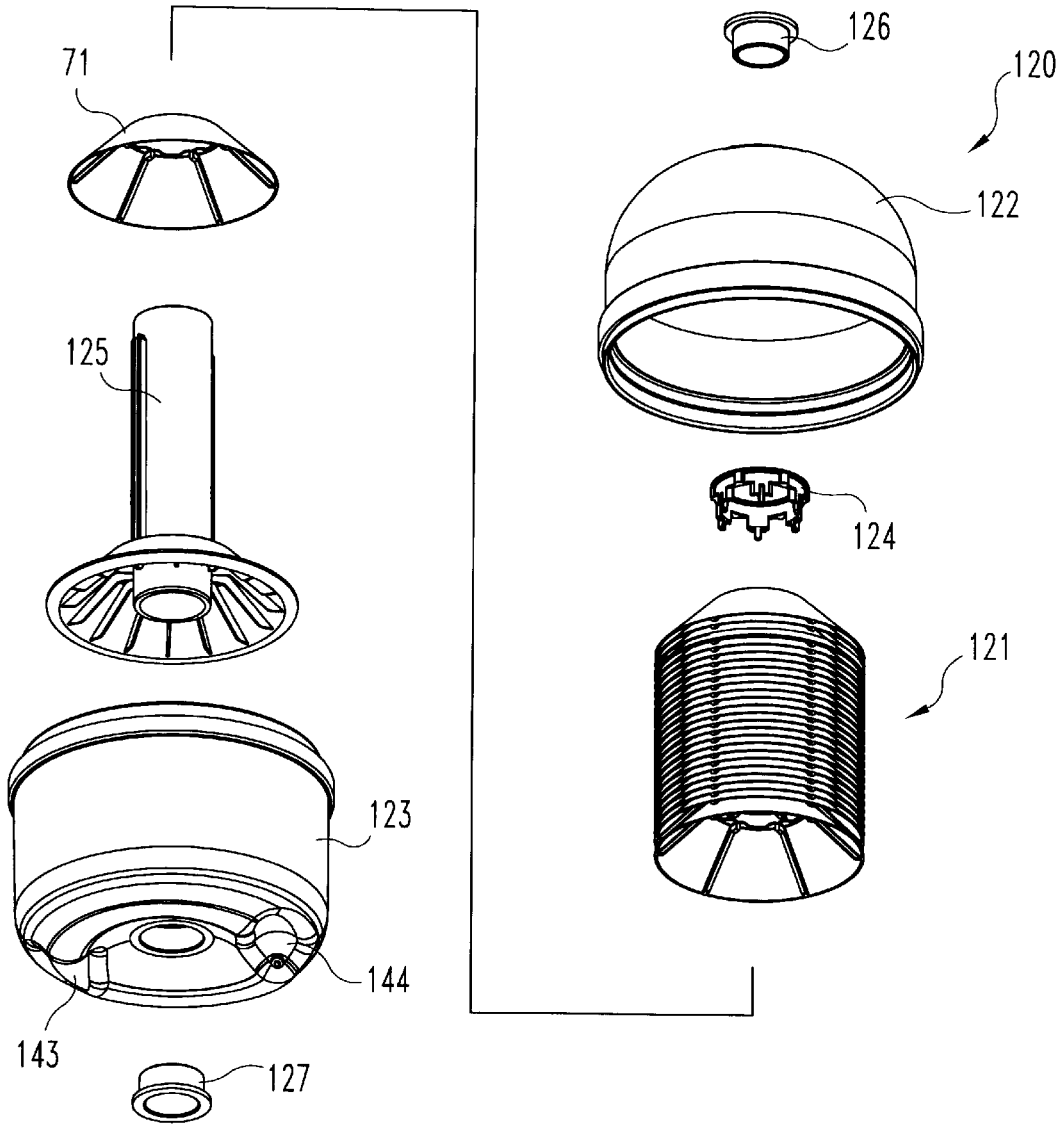
FIG. 23 is an exploded view of the FIG. 22 centrifuge assembly.
Figure 24:
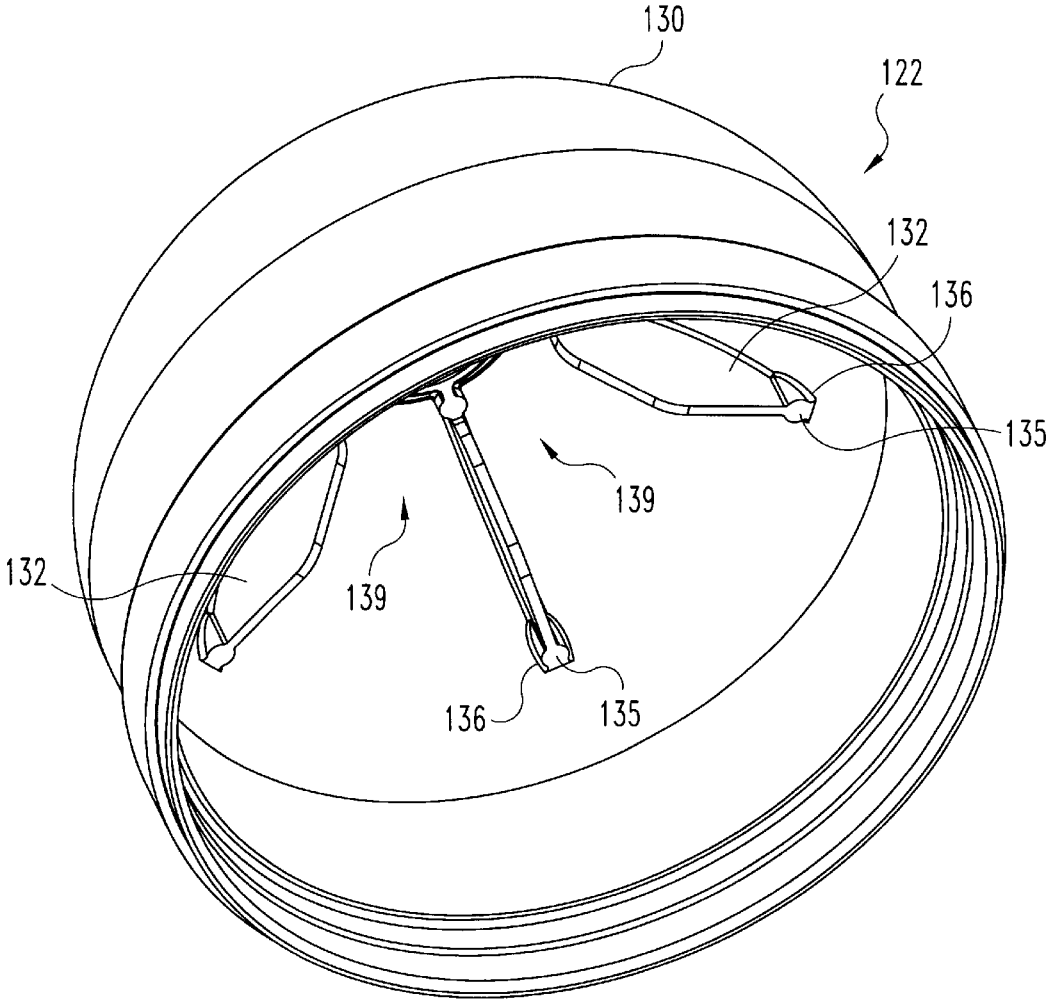
FIG. 24 is a perspective view of a rotor top shell which comprises one component of the FIG. 22 centrifuge assembly.
Figure 24A:
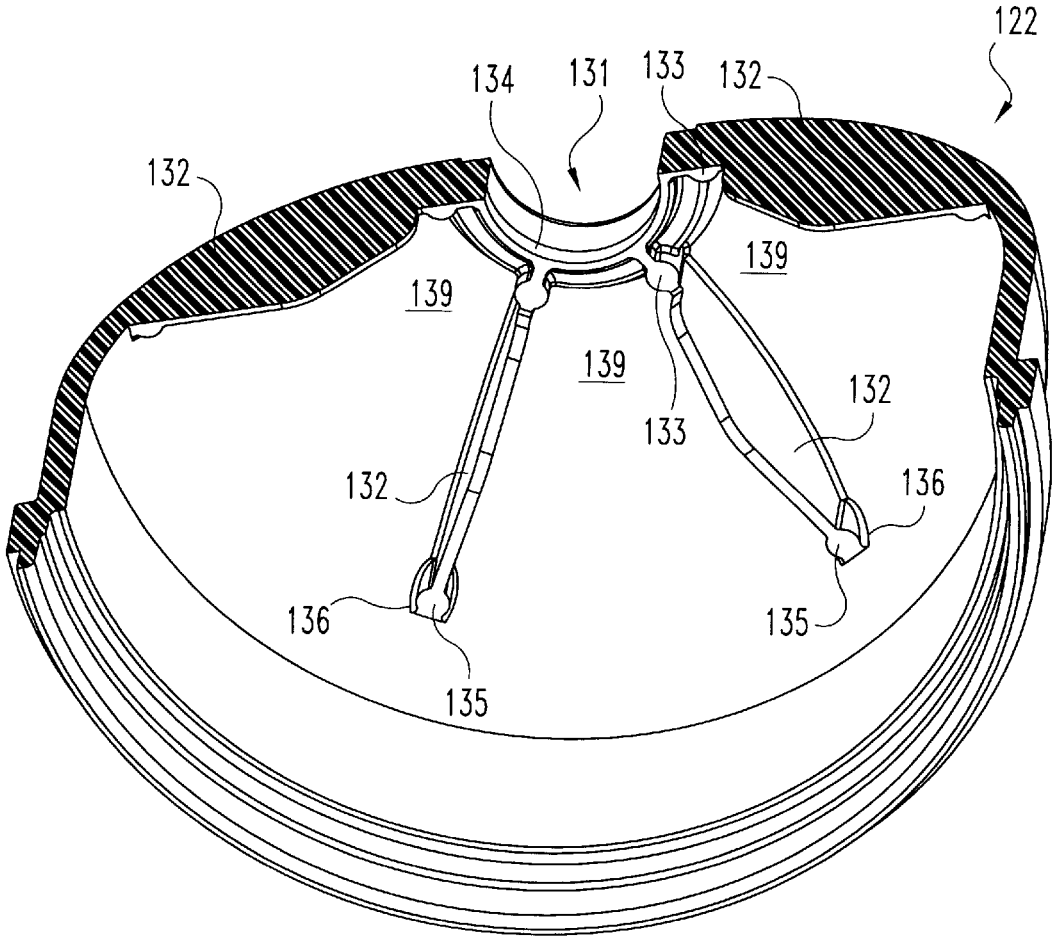
FIG. 24A is a fragmentary, partial perspective view of the FIG. 24 rotor top shell.
Figure 25:
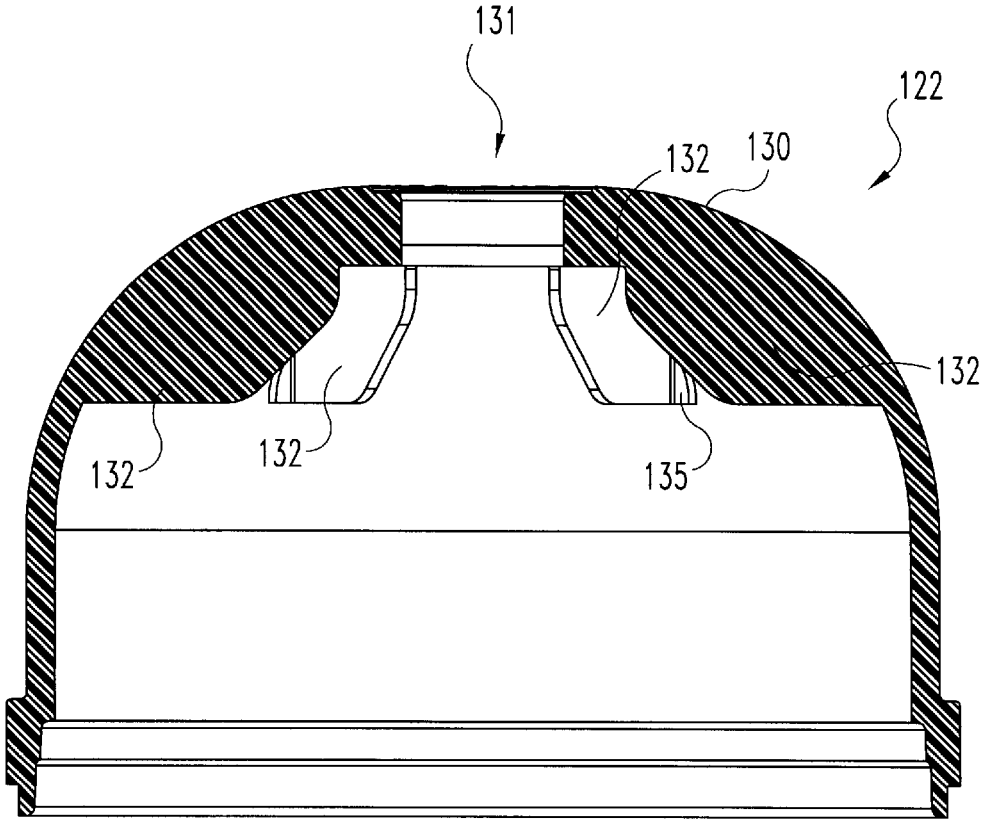
FIG. 25 is a front elevational view in full section of the FIG. 24 rotor top shell.

The unitary rotor top shell 122 is further illustrated in FIGS. 24, 24A, and 25. The unitary rotor bottom shell 123 is further illustrated in FIGS. 26, 27, and 28. The upper alignment spool 124 is further illustrated in FIGS. 29, 30, and 31. The hub 125 is further illustrated in FIGS. 32, 33, and 34. The two (unitary) bearings 126 and 127 each have a cylindrical body and an annular radial flange at one end of the cylindrical body. The FIG. 22 and FIG. 23 illustrations of these two bearings 126 and 127 should be sufficient for a clear understanding of their structure as well as their functioning in the context of centrifuge assembly 120. The upper bearing 126 is press-fit into the rotor top shell 122. The lower bearing 127 is press-fit into the rotor bottom shell 123. Each bearing is preferably made of oil-impregnated sintered brass. Alternative choices for the bearing material include machined brass and molded plastic.

In the embodiment of centrifuge assembly 20, the hub component 25 fits into hollow cylindrical sleeve 42. The inside cylindrical surface of second tube portion 51 provides the bearing surface for any centertube or shaft about which the centrifuge assembly 120 rotates. The design changes involving the use of bearing 127 involve changing the design of hub 25 in order to create hub 125, slight modifications to the rotor bottom shell 23 to create rotor bottom shell 123, and the press-fit of the bearing 127 into the rotor bottom shell 123.

The design changes involving the use of bearing 126 include changing the design of the alignment spool 24 in order to create alignment spool 124, slight modifications to the rotor top shell 22 in order to create rotor top shell 122, and the press-fit of the bearing 126 into the rotor top shell 122.

With reference to FIGS. 24, 24A, and 25, the rotor top shell 122 is illustrated in greater detail. The rotor top shell 122 is an injection molded, unitary part configured similarly in certain respects to rotor top shell 22. The primary differences in construction between rotor top shell 122 and rotor top shell 22 will be described herein. The domed upper surface 130 defines a centered, generally cylindrical aperture 131 which receives the upper bearing 126. The wall thickness of the portion of the rotor top shell that defines aperture 131 (rotor bore) is increased in a stepped fashion at the locations between the six equally-spaced acceleration vanes 132. The acceleration vanes provide radial flow channels that direct liquid to the inlet holes positioned in each cone of the cone-stack subassembly 121. The six vanes 132 are used to impart acceleration to the liquid and thus prevent "slip" of the liquid with respect to the spinning centrifugal rotor assembly 120. Each of the vanes 132 includes an axial edge which extends into an approximate 45 degree outwardly radiating edge. The set of six 45 degree vane edges are constructed and arranged for establishing proper engagement with the top surface of the cone-stack subassembly 121. The specific configuration and geometry of each vane 132 (see FIG. 24A) is slightly different from that of each vane 31. Most notably, each vane 132 includes an inner plateau 133 which is adjacent the inside defining surface 134 of aperture 131 and an outer plateau 135 at the tip 136 of each vane 132. The six clearance regions 139 which are in between each pair of adjacent vanes have a different geometry from the vanes as revealed by a comparison of the section views of FIG. 22 and FIG. 25. The clearance regions 139 are recessed in an upward axial direction relative to the axial position and extent of the vanes. However, whether referring to a clearance region 139 or to a vane 132, the defining wall for (rotor bore) aperture 131 extends axially for substantially the full length of the cylindrical body of bearing 126. This extended axial length for the (rotor bore) aperture 131 provides support for the upper bearing 126 and improves alignment of the bearing and the applied retention force.

Figure 26:
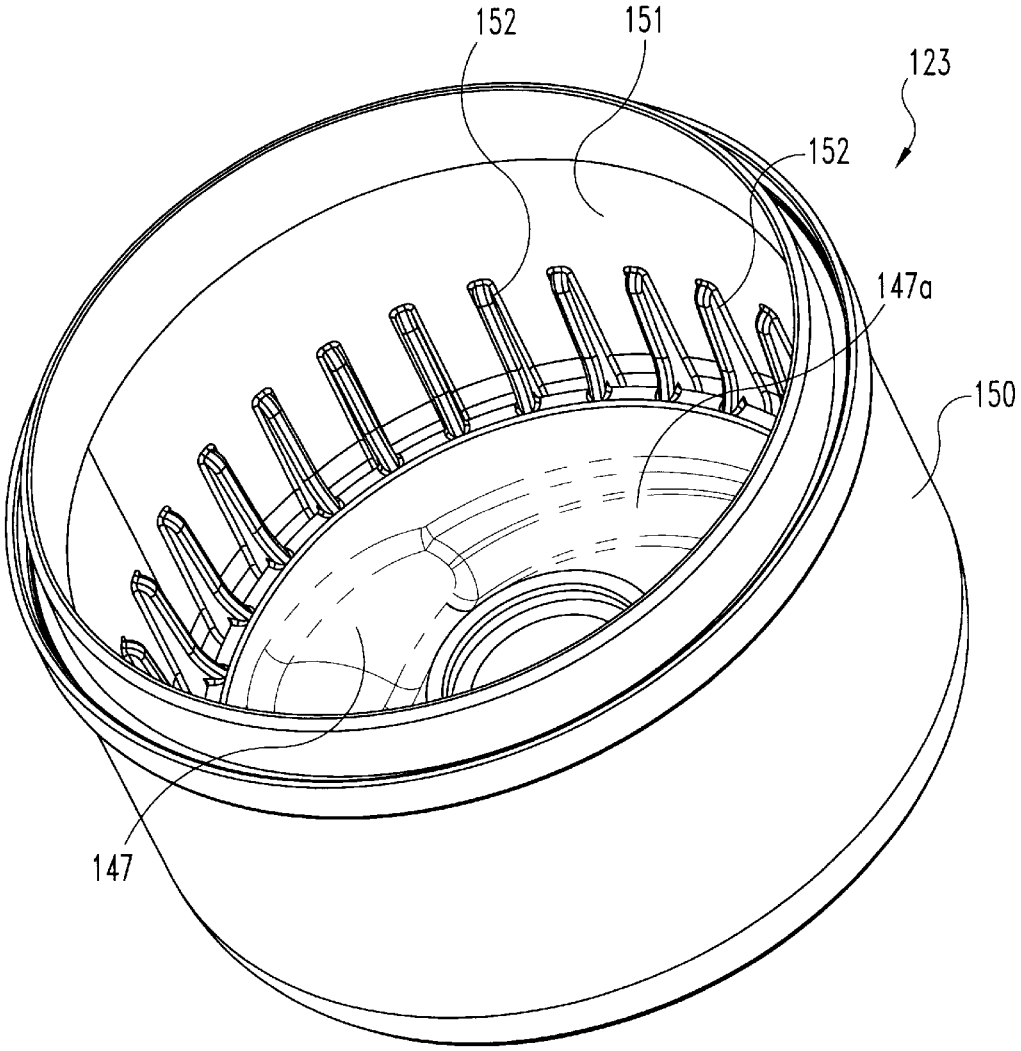
FIG. 26 is a perspective view of a rotor bottom shell which comprises one component of the FIG. 22 centrifuge assembly.
Figure 27:
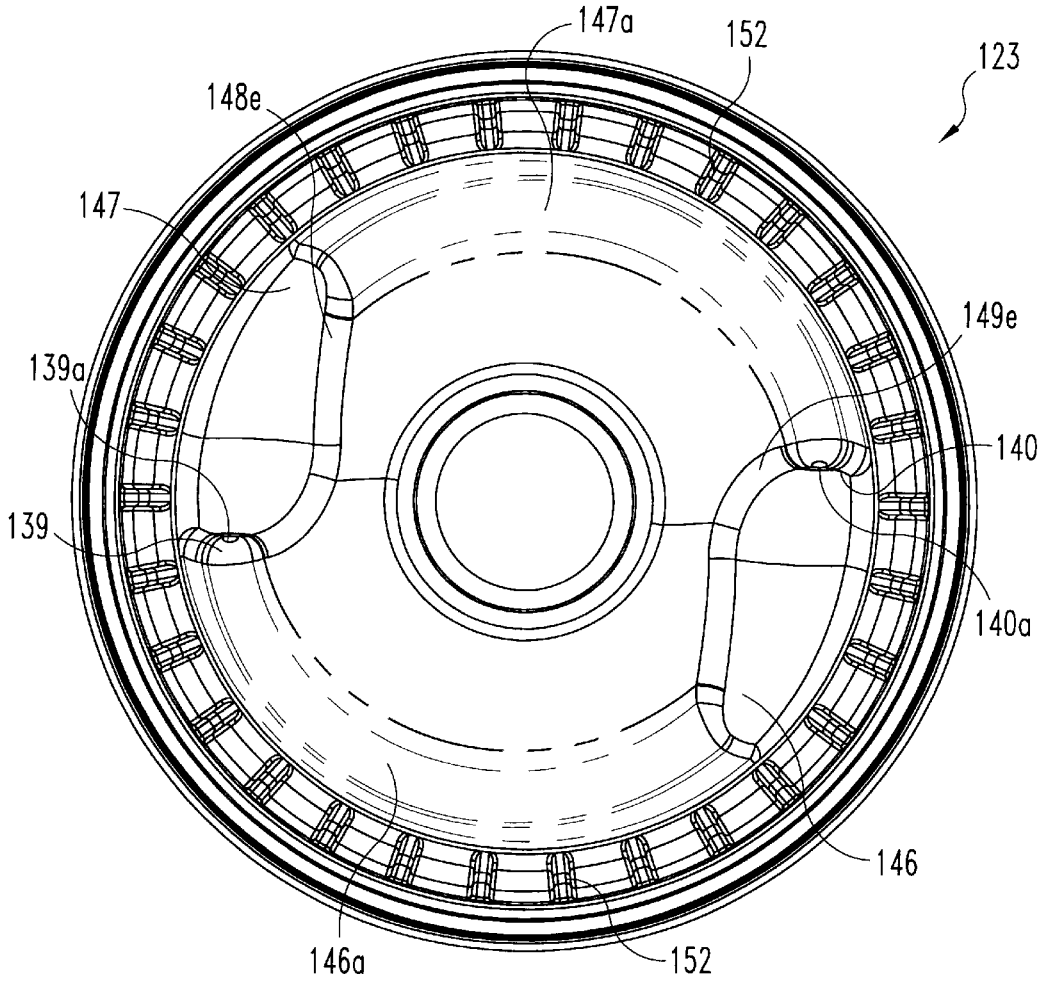
FIG. 27 is a top plan view of the FIG. 26 rotor bottom shell.
Figure 28:
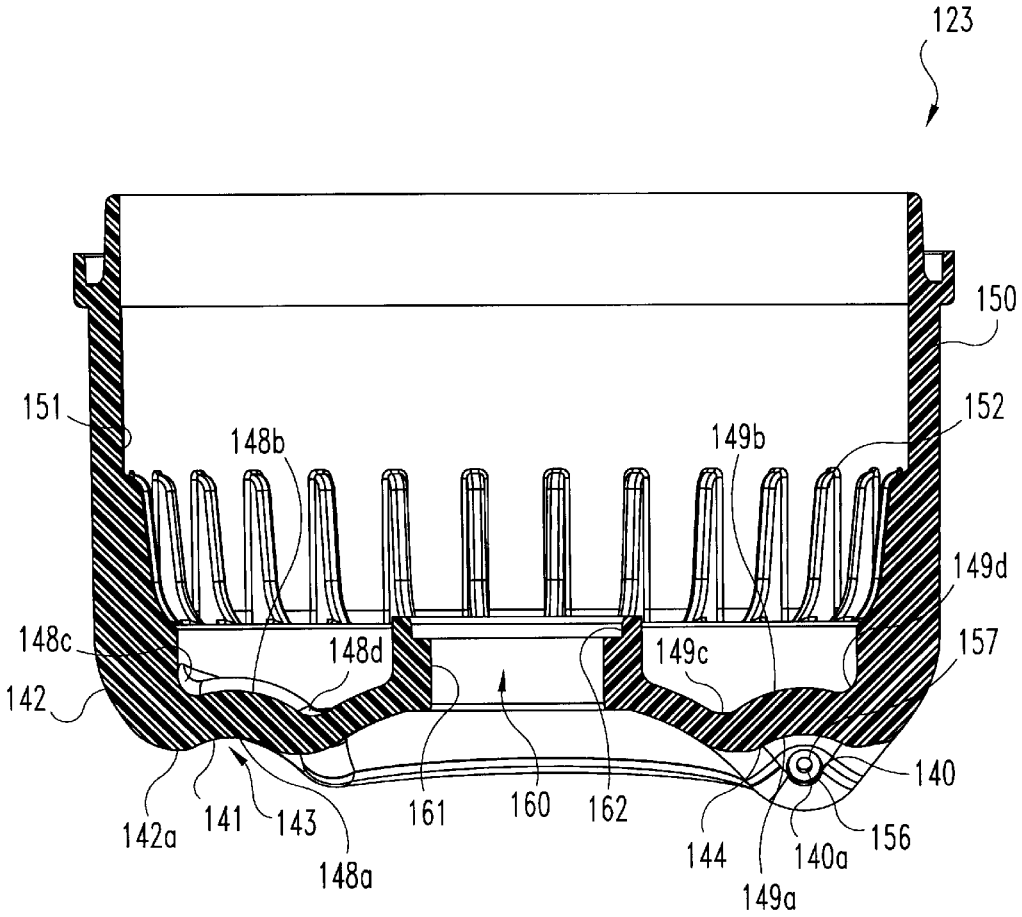
FIG. 28 is a front elevational view in full section of the FIG. 26 rotor bottom shell.

The rotor bottom shell 123 is illustrated in greater detail in FIGS. 26, 27 and 28. The assembly of the rotor bottom shell 123 to the rotor top shell 122 and the assembly of the other components into this rotor shell are illustrated in FIG. 22. The rotor top shell 122 and rotor bottom shell 123 are joined together into an integral shell by means of an "EMA Bond" weld at the lower annular edge of shell 122 and the upper annular edge of shell 123. The material and technique for the EMA Bond weld are offered by EMA Bond Systems, Ashland Chemicals, 49 Walnut Street, Norwood, N.J.

Rotor bottom shell 123 is a unitary, injection molded component which is constructed and arranged with two nozzle jets 139 and 140. These two nozzle jets are each oriented in a tangential direction, opposite to each other, such that the jets of exiting oil from each nozzle jet create the (self-driven) rotary motion for the centrifuge assembly 120.

The nozzle jets 139 and 140 each have a similar construction and the exit locations 139*a* and 140*a* on the exterior surface 141 of the base portion 142 of the rotor bottom shell 123 are surrounded by sculpted relief areas 143 and 144 (see FIGS. 23 and 28). These sculpted relief areas are smoothly curved, rounded in shape so as to minimize stress concentration points which are typically associated with corners and edges. The interior surface 145 of the base portion 142 is constructed and arranged with sculpted inlets 146 and 147 and enclosed flow jet passageways 146*a* and 147*a*, respectively. As the returning oil from the cone-stack subassembly enters the rotor bottom shell 123, it flows into each passageway 146*a* and 147*a* and exits from each corresponding nozzle jet 139 and 140, respectively, such that the exit velocity creates an equal and opposite force, causing centrifuge assembly rotation.

The specific configuration of the sculpted relief areas can best be understood by considering FIGS. 27 and 28 in view of the following description. Reference to FIGS. 23 and 26 may also be helpful. First, the bottom wall 142*a* of the base portion 142 is generally conical in form with a recessed center portion leading into bearing bore 160 (see FIG. 28). The outer edge of this conical form is rounded and constitutes what would be the lowermost edge or surface of the rotor shell. It is in this outer edge or outer margin where the sculpted inlets 146 and 147 and flow jet passageways 146*a* and 147*a* are created. At the points where flow is desired to exit from the rotor by way of the defined nozzle jets 139 and 140, a wall for each nozzle jet is created by shaping or sculpting a corresponding concave relief area 148*a* and 149*a* (one for each nozzle jet) by shaping and sculpting the geometry of the bottom wall 142*a* around each flow exit location.

The sculpted relief areas 143 and 144 and the sculpted inlets 145 and 146 need to be considered as part of the overall geometry of the bottom wall 142*a* and the sculpted relief areas surrounding the two nozzle jets. The shaping of the bottom wall 142*a*, as illustrated in FIG. 28, includes a sculpted wall portion 148*b* for relief area 143 and a sculpted wall portion 149*b* for relief area 144. These wall portions are bounded by radiused areas 148*c*, 148*d*, 149*c*, and 149*d*. The defining boundary for each relief area is illustrated in FIG. 27 by radiused outlined 148*e* for relief area 143 and by radiused outline 149*e* for relief area 144.

The sculpting of the region around each nozzle jet reduces stress concentration points. While the greater the radius of curvature, the less the stress concentration, there are practical limits on what radius can be used and these practical limits are influenced principally by wall thickness and by the overall size of the rotor assembly. The radius of curvature relative to the wall thickness should have a radius-to-thickness ratio of something greater than 0.5. In the current design, this ratio is approximately 0.73.

The generally cylindrical sidewall 150 of the rotor bottom shell 123 includes as part of its inner surface 151 an equally-spaced series of strengthening ribs 152. There are a total of thirty ribs, each one having a generally triangular shape, with the "hypotenuse" edge directed inwardly and extending axially. These ribs 152 have been shown to reduce the concentration of stress that is found in the transition zone between the sidewall and the bottom, nozzle end of the rotor. High internal fluid pressure encountered during engine startup conditions can lead to fatigue and possible cracking of the material if the stress concentration is not reduced by these ribs 152.

The outlet 140*a* of nozzle jet 140 is illustrated in FIG. 28. Included is an oversized "relief" counterbore 156 which is designed to minimize the length of the nozzle jet aperture 157 through the plastic comprising the wall of the base portion 142. Without the counterbore 156, the smaller aperture 157 is extended in length and acts as a capillary tube which substantially reduces the velocity discharge coefficient of the exiting jet. In turn, this reduced jet velocity reduces the rotor speed. The diameter-to-length ratio should be kept greater than approximately 1.0 in order to generate a sufficient jet velocity for the desired rotor speed (i.e., speed or rate of rotation).

The base portion 142 of the rotor bottom shell 123 defines cylindrical bearing bore 160 which is centered in base portion 142 and is concentric with sidewall 150. The geometric center of bearing bore 160 coincides with the geometric center of aperture 131 and with the axis of rotation for centrifuge assembly 120. Sidewall 161, which defines bearing bore 160, includes an interior offset shoulder 162 or step in the upper edge of the inner surface. This shoulder 162 is circular, substantially flat, and with a uniform radial width around its circumference. The cylindrical volume or void created by shoulder 162 is sized and shaped in order to receive the cylindrical lower end of hub 125, see FIG. 22. The interior of bearing bore 160 receives the lower bearing 127 with a light press fit.

Figure 29:
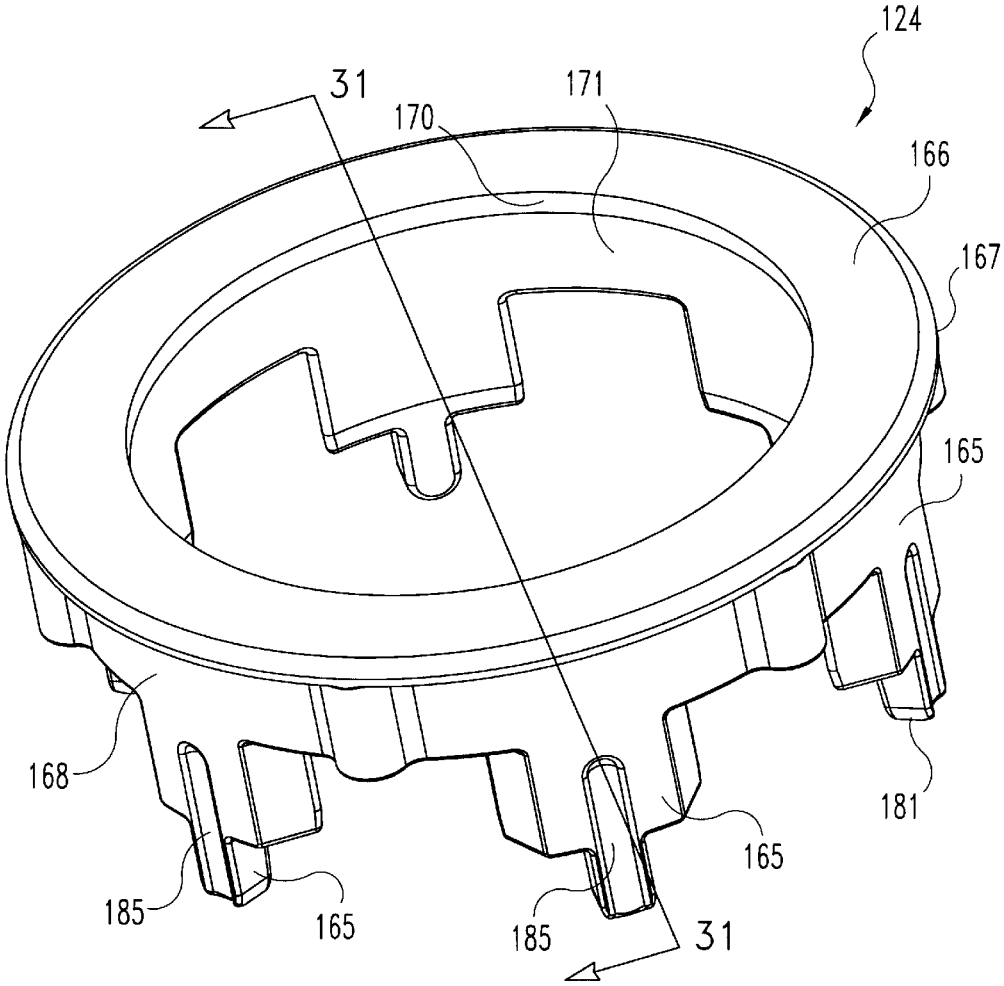
FIG. 29 is a perspective view of an upper alignment spool which comprises one component of the FIG. 22 centrifuge assembly.
Figure 30:
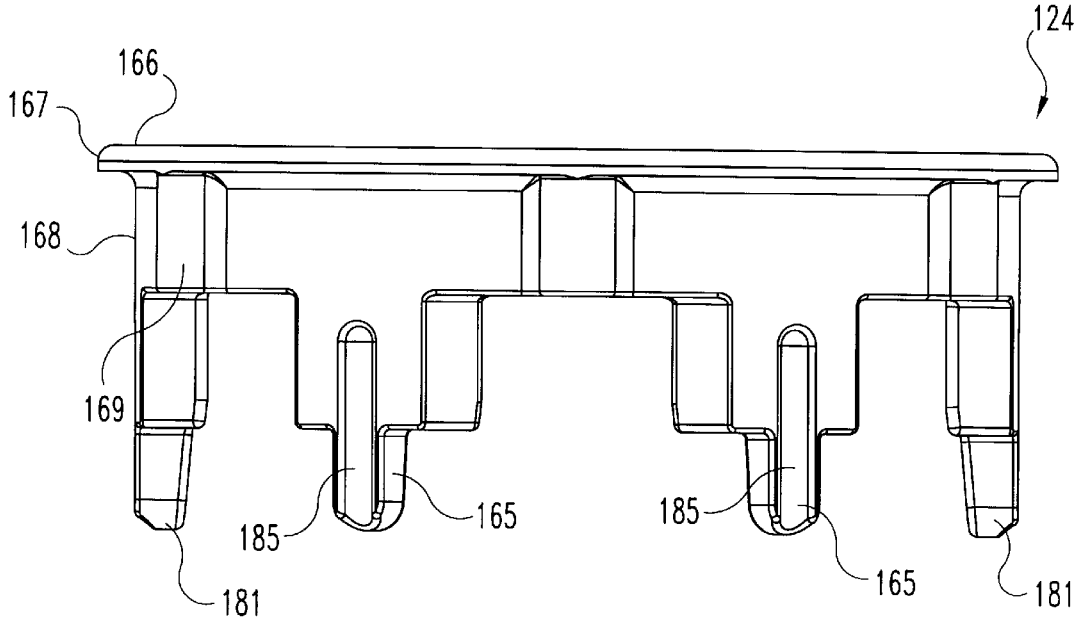
FIG. 30 is a front elevational view of the FIG. 29 upper alignment spool.
Figure 31:
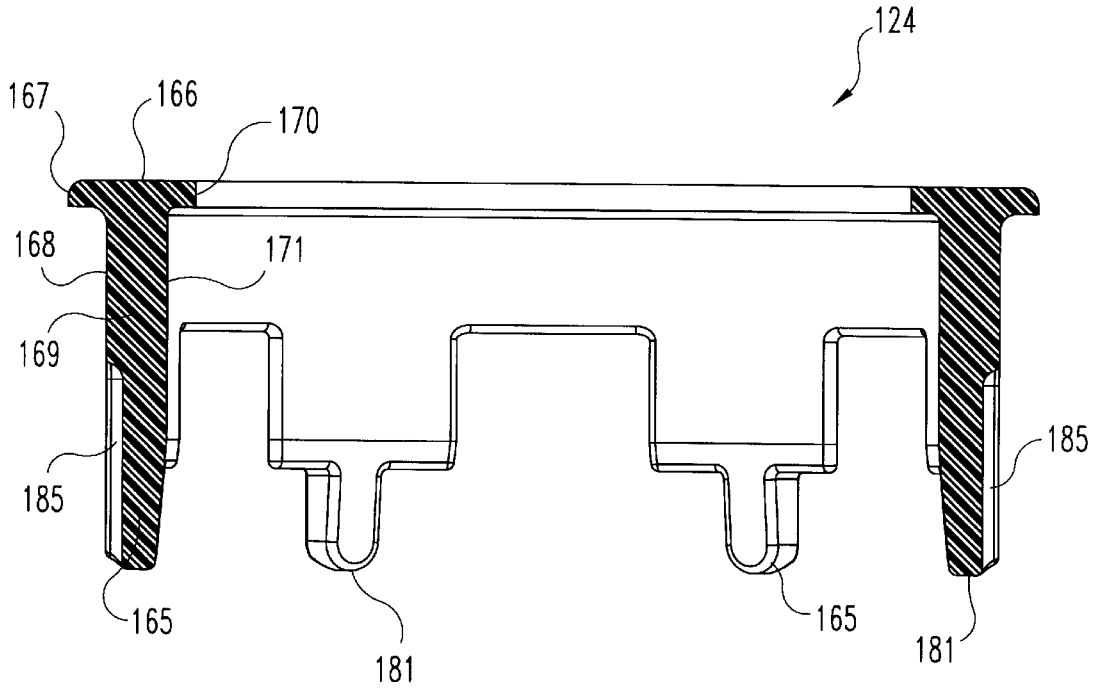
FIG. 31 is a front elevational view in full section of the FIG. 29 upper alignment spool as viewed along line 31—31 in FIG. 29.

The upper alignment spool 124 is illustrated in FIGS. 29, 30 and 31. This unitary component is injection molded out of plastic and assembled into the centrifuge assembly 120 as illustrated in FIGS. 22 and 23. The upper alignment spool 124 has an annular ring shape with a series of six equally-spaced, downwardly extending fingers 165. The upper flange 166 has an outer lip 167 which radially extends, outwardly, beyond the outer surface 168 of sidewall 169. The inner lip 170 of flange 166 radially extends, inwardly, beyond the inner surface 171 of sidewall 169.

When installed into the centrifuge assembly 120, the fingers 165 fit down in between the outer surface of hub 125 and the inner, inside diameter edge of the top two cones of the cone-stack subassembly 121. The underside of the inner lip 170 rests on the top edge surface 174 of the hub 125. The radial width of inner lip 170 is approximately the same dimension as the wall thickness of the tube portion 175 of hub 125. The inner plateau 133 of each vane 132 rests on the upper surface of upper flange 166. As illustrated in FIG. 16 (single cone), the inner, inside diameter edge of each cone includes an equally-spaced series of relief notches or openings 85 which are constructed and arranged to receive a corresponding one of the downwardly extending fingers 165 of the upper alignment spool 124.

The upper alignment spool 124 concentrically aligns the top of the hub 125 by way of the engagement between the outer surface of the hub and the inner surfaces of the radial acceleration vanes 132 which are located adjacent the upper, inner surface of the rotor top shell 122. The inner vane surfaces are parallel to the axis of rotation. The top of the alignment spool 124 and the molded-in acceleration vanes create flow passageways for the fluid to pass from the hub 125 into the radial "pie-shaped" acceleration zones created by the radial vanes 132. If the alignment spool 124 and cone-stack subassembly 121 are omitted, then the hub outside diameter would directly engage the inside diameter surfaces of the vanes, in what would be viewed as an alternative construction which omits the cone-stack subassembly and without the cone-stack subassembly, the alignment spool 124 is not required.

Several important functions associated with the operation of centrifuge assembly 120 involve the use of alignment spool 124. First, the fingers 165 have a trapezoidal-like shape in horizontal cross section (cutting plane perpendicular to the axis of rotation). This trapezoidal-like shape corresponds to the shape of the relief notches 85 and the fingers 165 fit into these relief notches which function as cone outlet slots. Since the finger-into-notch engagement occurs in the top cones (typically the top two cones), these outlets are closed off to flow, preventing flow from bypassing the cone-stack subassembly 121. As a result of this construction, the flow must pass up and around the alignment spool and across the top cone and radially outwardly since the alignment spool closes off the top cone flow (outlet) holes.

This method (and structure) of closing off the top cone flow outlets, as compared to a flat face seal on the cone top flat surface, provides a desirable tolerance range or adjustment for a stack-up height variation which may be present. There may also be a need to provide for an accommodation of height variations in the cone-stack subassembly 121 when one cone is missing, i.e., a "short stack". Even when the dimensions go small due to low side tolerances or when a cone is omitted, the fingers 165 are axially long enough to still engage the outlet holes (i.e., the relief notches) of the top cone in the cone-stack subassembly.

As an alternative to using the alignment spool 124 to close off the flow outlets of the top cone of the cone-stack subassembly, a "special" top cone can be molded without any flow outlets. This alternative though is believed to be a more costly approach due to the special tooling and a more complicated assembly procedure.

Each of the depending fingers 165 of the alignment spool 124 includes a smaller protrusion 181 at its lower end or tip. Two oppositely-disposed ones of these protrusions 181 mate with a pair of oppositely-disposed (180 degrees apart) longitudinal ribs 182, molded as part of the tube portion 175 of hub 125. Each rib 182 defines a centered slot 183, and the protrusions 181 fit into a corresponding one of the centered slots 183. The slots 183 between the ribs 182 allow flow from that sector of the cone-stack subassembly 121 to pass downward to the exit outlet. Each protrusion 181 includes a recessed indentation 185 in the outer surface of the protrusion. These indentations 185 are provided in order to allow flow to escape from the top (spool-engaged) inter-cone gaps.

The interfit of the two protrusions 181 into the two defined slots 183 effectively "lock in " the alignment between the spool 124, the cone-stack subassembly 121, and the hub 125. This assembly arrangement prevents any rotational misalignment of the cone-stack subassembly during assembly, welding, and subsequent operation. This assembly arrangement also enables the quick and easy assembly and is immune to subsequent misalignment due to the previously mentioned "short stack" due to a missing cone or a short-end tolerance stack. The individual cones are still self-aligning with the V-shaped ribs (i.e., vanes 74) and the V-shaped grooves 83 as described in the context of FIG. 17. The earlier embodiment of the present invention, see FIGS. 11 and 12, relies on a telescoping combination of tube portion 50 and conical base 48 in order to adjust for a "short stack".

Figure 32:
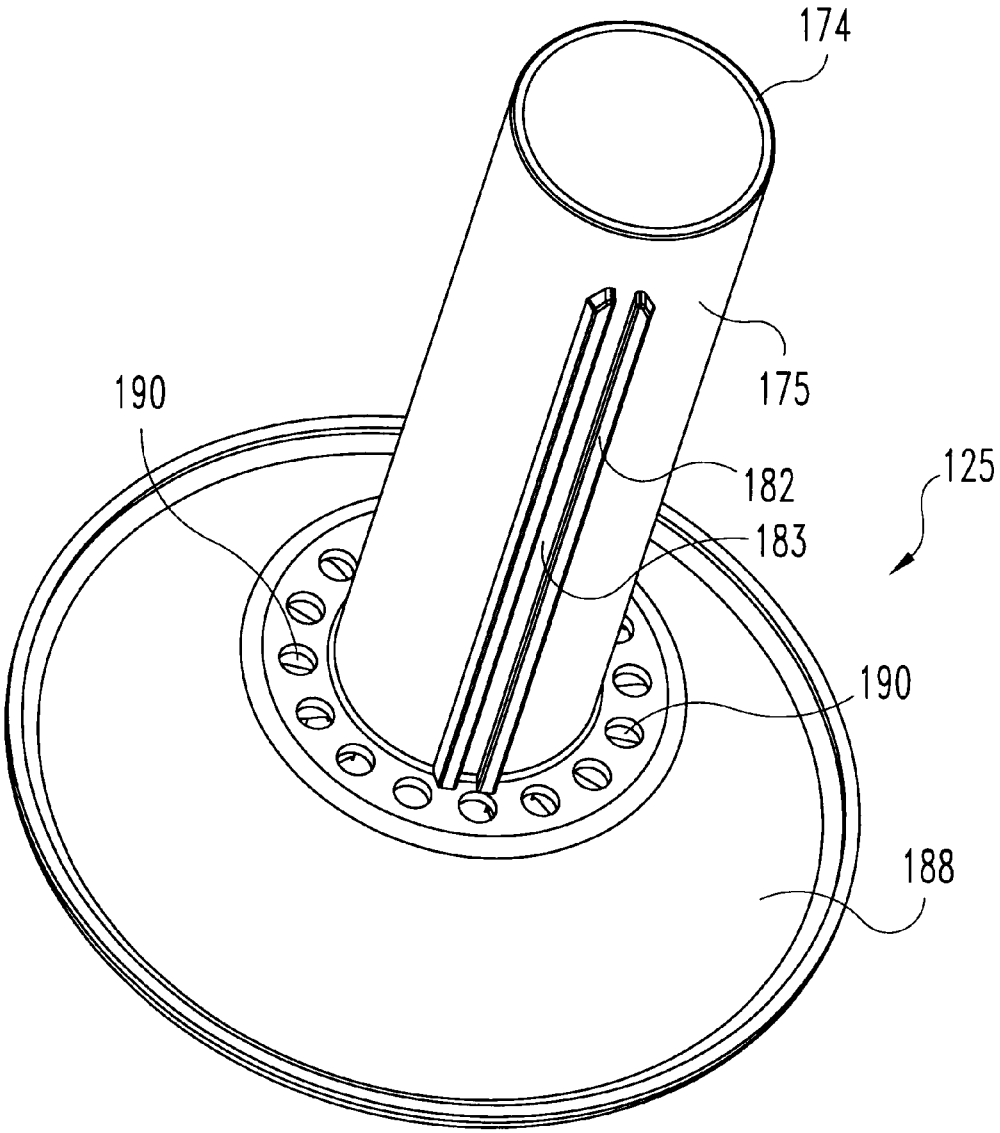
FIG. 32 is a perspective view of a hub which comprises one component of the FIG. 22 centrifuge assembly.
Figure 33:
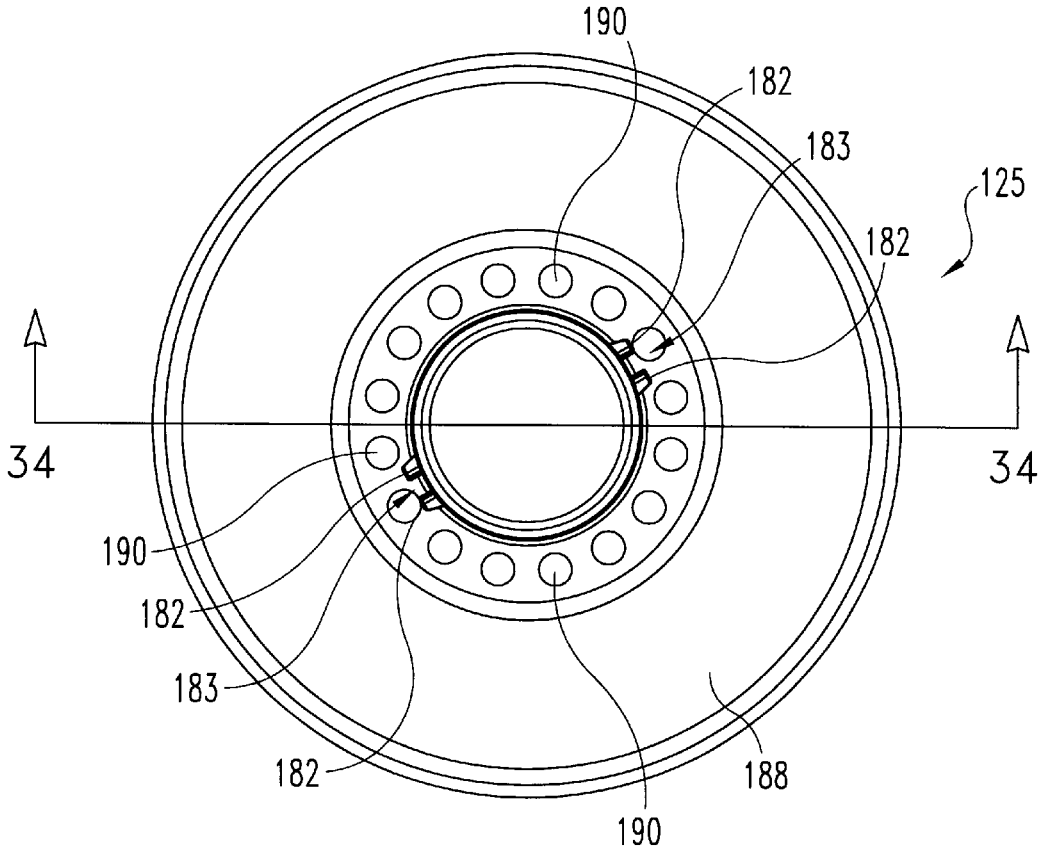
FIG. 33 is a top plan view of the FIG. 32 hub.
Figure 34:
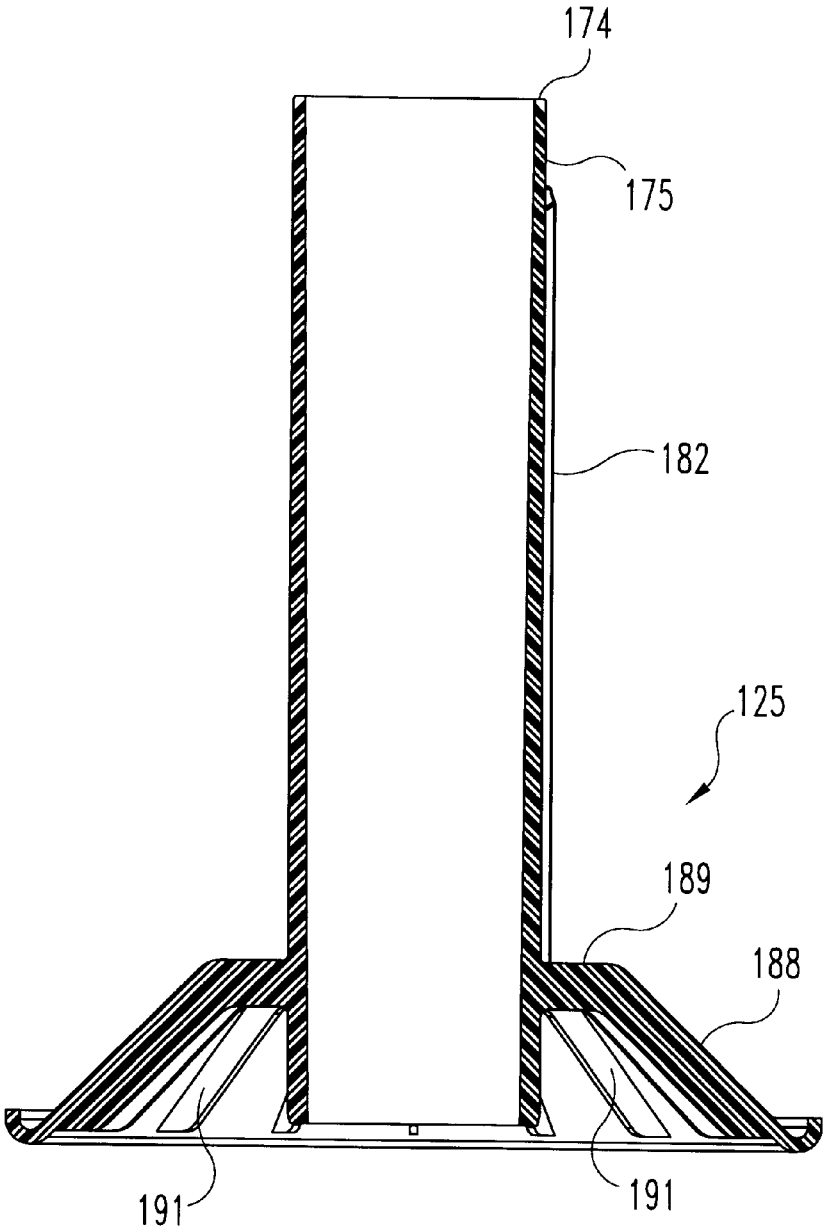
FIG. 34 is a front elevational view, in full section, of the FIG. 32 hub as viewed along line 34—34 in FIG. 33.

With reference to FIGS. 32, 33, and 34, the hub 125 is illustrated and many of the features of hub 125 have already been described in the context of describing other components. Hub 125 is a unitary, molded plastic component including a generally cylindrical tube portion 175 and a frustoconical base 188. The tube portion 175 is centered on and concentric with base 188 and the upper surface 189 of the base 188 includes an annular ring pattern of flow-exit, outlet holes 190. A total of sixteen outlet holes 190 are provided and the annular-ring pattern is concentric to tube portion 175. The base 188 is configured with a series of equally-spaced radial webs 191 which are located in alternating sequence between adjacent outlet holes 190. The radial webs 191 are provided in order to help reduce long-term creep of the base 188, due to any pressure gradient between the "cone side" and the rotor base side of the conical surface, which can occur in high temperature environments during sustained operation.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A disposable, self-driven centrifuge rotor assembly for separating an undesired constituent out of a circulating fluid, said disposable, self-driven centrifuge comprising:

a first rotor shell portion;

a second rotor shell portion having an internal annular wall and being joined to said first rotor shell portion so as to define a hollow interior;

a support hub having a base with an annular wall and a tubular portion, said support hub being assembled into said second rotor shell portion with said tubular portion extending into said hollow interior, said annular wall being constructed and arranged into a sealed interface against said internal annular wall of said second rotor shell portion;

an alignment spool assembled into engagement with said support hub and extending into said hollow interior;

particulate separation means positioned in said hollow interior for separating particulate matter out of said circulating fluid; and wherein said base of said support hub is generally frustoconical in shape.

2. The disposable, self-driven centrifuge rotor assembly of claim 1 wherein said base includes a plurality of radial webs.

3. The disposable, self-driven centrifuge rotor assembly of claim 2 wherein said base defines a plurality of flow apertures.

4. The disposable, self-driven centrifuge rotor assembly of claim 3 wherein one flow aperture is positioned between each pair of adjacent radial webs.

5. The disposable, self-driven centrifuge of claim 1 wherein said first and second rotor shell portions are injection molded from plastic material.

6. The disposable, self-driven centrifuge of claim 5 wherein said first and second rotor shell portions are welded together into an integral combination.

7. The disposable, self-driven centrifuge of claim 1 wherein said second rotor shell portion defines a substantially cylindrical sleeve and said tubular portion fitting into said substantially cylindrical sleeve.

8. The disposable, self-driven centrifuge of claim 1 wherein said first and second rotor shell portions are welded together into an integral combination.

9. The disposable, self-driven centrifuge of claim 1 wherein said first rotor shell portion, said second rotor shell portion, said support hub, and said alignment spool are each injection molded from a plastic material.

10. The disposable, self-driven centrifuge of claim 9 which further includes a first bearing assembled into said first rotor shell portion.

11. The disposable, self-driven centrifuge of claim 10 which further includes a second bearing assembled into said second rotor shell portion.

12. The disposable, self-driven centrifuge of claim 1 wherein said particulate separation means includes a cone-stack subassembly including a plurality of individual separation cones arranged into an aligned stack with flow spacing between adjacent cones.

13. A disposable, self-driven centrifuge rotor assembly for separating an undesired constituent out of a circulating fluid, said disposable, self-driven centrifuge comprising:

a first rotor shell portion;

a second rotor shell portion having an internal annular wall and being joined to said first rotor shell portion so as to define a hollow interior;

a support hub having a base with an annular wall and a tubular portion, said support hub being assembled into said second rotor shell portion with said tubular portion extending into said hollow interior, said annular wall being constructed and arranged into a sealed interface against said internal annular wall of said second rotor shell portion;

wherein said base of said support hub is generally frustoconical in shape; and wherein said base includes a plurality of radial webs.

14. The disposable, self-driven centrifuge rotor assembly of claim 13 wherein said base defines a plurality of flow apertures.

15. The disposable, self driven centrifuge rotor assembly of claim 14 wherein one flow aperture is positioned between each pair of adjacent radial webs.

16. A disposable, self-driven centrifuge rotor assembly for separating an undesired constituent out of a circulating fluid, said disposable, self-driven centrifuge comprising:

a first rotor shell portion;

a second rotor shell portion joined to said first rotor shell portion so as to define a hollow interior;

a support hub assembled into said second rotor shell portion and extending into said hollow interior;

an alignment spool assembled into engagement with said support hub and extending into said hollow interior;

a cone-stack subassembly including a plurality of individual separation cones arranged into an aligned stack with flow spacing between adjacent cones, said cone-stack subassembly being positioned within said hollow interior and cooperatively assembled between said support hub and said alignment spool; and wherein said second rotor shell portion includes a first jet nozzle outlet which is constructed and arranged with a smaller diameter first section and a counterbored larger diameter second section, wherein a fluid flow exiting from said rotor assembly enters said first section and exits from said second section.

17. The disposable, self-driven centrifuge rotor assembly of claim 16 wherein said second rotor shell portion includes a second jet nozzle outlet which is constructed and arranged with a smaller diameter first section and a counterbored larger diameter second section, wherein a fluid flow exiting from said rotor assembly enters said first section and exits from said second section.

18. A disposable, self-driven centrifuge rotor assembly for separating an undesired constituent out of a circulating fluid, said disposable, self-driven centrifuge comprising:

a first rotor shell portion;

a second rotor shell portion having an internal annular wall and being joined to said first rotor shell portion so as to define a hollow interior;

a support hub having a base with an annular wall and a tubular portion, said support hub being assembled into said second rotor shell portion with said tubular portion extending into said hollow interior, said annular wall being constructed and arranged into a sealed interface against said internal annular wall of said second rotor shell portion;

an alignment spool assembled into engagement with said support hub and extending into said hollow interior;

particulate separation means positioned in said hollow interior for separating particulate matter out of said circulating fluid; and wherein said second rotor shell portion includes a first jet nozzle outlet which is constructed and arranged with a smaller diameter first section and a counterbored larger diameter second section, wherein a fluid flow exiting from said rotor assembly enters said first section and exits from said second section.

19. The disposable, self-driven centrifuge rotor assembly of claim 18 wherein said second rotor shell portion includes a second jet nozzle outlet which is constructed and arranged with a smaller diameter first section and a counterbored larger diameter second section, wherein a fluid flow exiting from said rotor assembly enters said first section and exits from said second section.

20. A disposable, self-driven centrifuge rotor assembly for separating an undesired constituent out of a circulating fluid, said disposable, self-driven centrifuge comprising:

a first rotor shell portion;

a second rotor shell portion joined to said first rotor shell portion so as to define a hollow interior;

an alignment spool positioned in said first rotor shell portion and including a sidewall which defines a hollow interior;

a support hub positioned in said second rotor shell portion and extending in the direction of said alignment spool, the hollow interior of said alignment spool receiving a portion of said support hub; and wherein said second rotor shell portion includes a first jet nozzle outlet which is constructed and arranged with a smaller diameter first section and a counterbored larger diameter second section, wherein a fluid flow exiting from said rotor assembly enters said first section and exits from said second section.

21. The disposable, self-driven centrifuge rotor assembly of claim 20 wherein said second rotor shell portion includes a second jet nozzle outlet which is constructed and arranged with a smaller diameter first section and a counterbored larger diameter second section, wherein a fluid flow exiting from said rotor assembly enters said first section and exits from said second section.

22. A disposable, self-driven centrifuge rotor assembly for separating an undesired constituent out of a circulating fluid, said disposable, self-driven centrifuge comprising:

a first rotor shell portion;

a second rotor shell portion joined to said first rotor shell portion so as to define a hollow interior;

a support hub assembled into said second rotor shell portion and extending into said hollow interior; and said second rotor shell portion including a jet nozzle outlet which is constructed and arranged with a smaller diameter first section and a counterbored larger diameter second section, wherein a fluid flow exiting from said rotor assembly enters said first section and exits from said second section.

* * * * *